US009155956B2

(12) United States Patent
Rullier et al.

(10) Patent No.: US 9,155,956 B2
(45) Date of Patent: Oct. 13, 2015

(54) TOEPIECE WHICH RELEASES AUTOMATICALLY AS A RESULT OF TWISTING

(71) Applicant: Skis Rossignol, Saint-Jean-de-Moirans (FR)

(72) Inventors: Pierre Rullier, Annecy le Vieux (FR); Arnaud Moenne Loccoz, Grenoble (FR)

(73) Assignee: SKIS ROSSIGNUL, Saint-Jean-de-Moirans (FR)

( * ) Notice: Subject to any disclaimer, the term of this patent is extended or adjusted under 35 U.S.C. 154(b) by 0 days.

(21) Appl. No.: 14/186,433

(22) Filed: Feb. 21, 2014

(65) Prior Publication Data

US 2014/0239615 A1 Aug. 28, 2014

(30) Foreign Application Priority Data

Feb. 22, 2013 (FR) ..... 13 51596
Jan. 24, 2014 (EP) ..... 14152476

(51) Int. Cl.

| | |
|---|---|
| ***A63C 9/10*** | (2012.01) |
| ***A63C 9/08*** | (2012.01) |
| ***A63C 9/085*** | (2012.01) |
| ***A63C 9/086*** | (2012.01) |

(52) U.S. Cl.

CPC . *A63C 9/10* (2013.01); *A63C 9/086* (2013.01); *A63C 9/0807* (2013.01); *A63C 9/08528* (2013.01)

(58) Field of Classification Search

CPC .... A63C 9/00; A63C 9/0807; A63C 9/08521; A63C 9/086; A63C 9/08528; A63C 9/10
USPC ..... 280/616, 611, 11.33
See application file for complete search history.

(56) References Cited

U.S. PATENT DOCUMENTS

| | | | | |
|---|---|---|---|---|
| 4,348,036 | A * | 9/1982 | Settembre | 280/615 |
| 2004/0070177 | A1 | 4/2004 | Buquet et al. | |
| 2011/0025003 | A1* | 2/2011 | Moore et al. | 280/11.33 |
| 2011/0271557 | A1* | 11/2011 | Barthel | 36/117.1 |

(Continued)

FOREIGN PATENT DOCUMENTS

| | | | | |
|---|---|---|---|---|
| DE | 102012206880 | * | 4/2012 | A63C 9/00 |
| EP | 1 393 783 | A | 3/2004 | |

(Continued)

OTHER PUBLICATIONS

Search Report issued by French Patent Office for priority application FR 1351596 dated Oct. 21, 2013.

*Primary Examiner* — Brodie Follman
*Assistant Examiner* — Brian Cassidy
(74) *Attorney, Agent, or Firm* — Frommer Lawrence & Haug LLP

(57) ABSTRACT

A toepiece (10) for a binding device for securing a boot to a gliding board comprises a fixed part (11) which is intended to be secured to the gliding board, and a mobile part (12) which is mounted on the fixed part with a possibility of relative movement (T) with at least one transverse component and on which two jaws (13*d*, 13*g*) are mounted so as to pivot about a substantially longitudinal axis (Ag, Ad). The toepiece (10) comprises a lever (16) that is actuable from the outside of the toepiece (10) and takes up a blocking position in which blocking elements (25*d*, 25*g*) that are integral with the lever (16) prevent the jaws (13*d*, 13*g*) from tilting so as to keep the toepiece (10) in a closed configuration in which the jaws (13*d*, 13*g*) retain the boot.

23 Claims, 14 Drawing Sheets

(56) References Cited

U.S. PATENT DOCUMENTS

Figure 1:
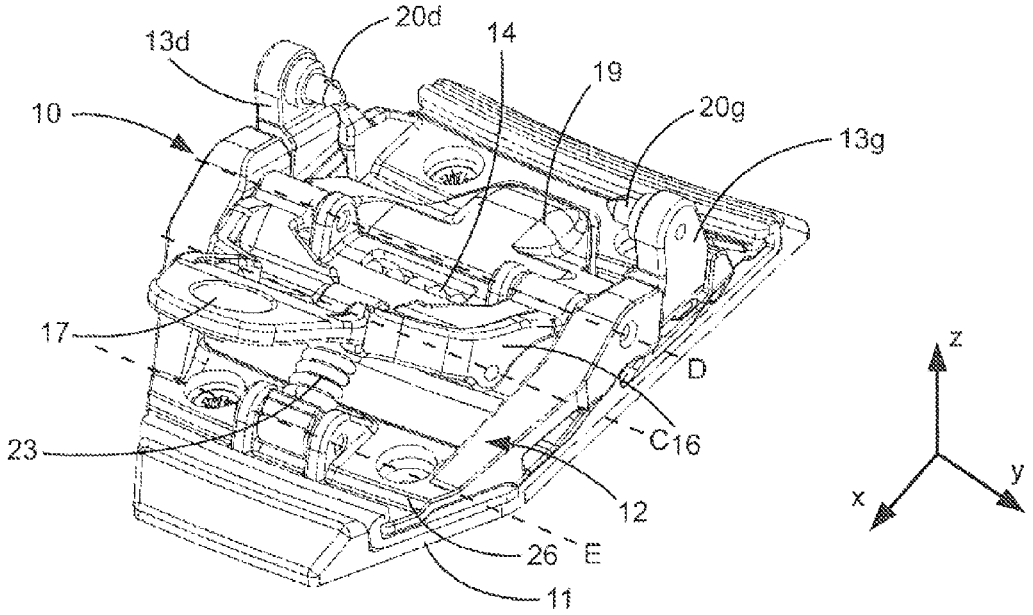
Figure 2:
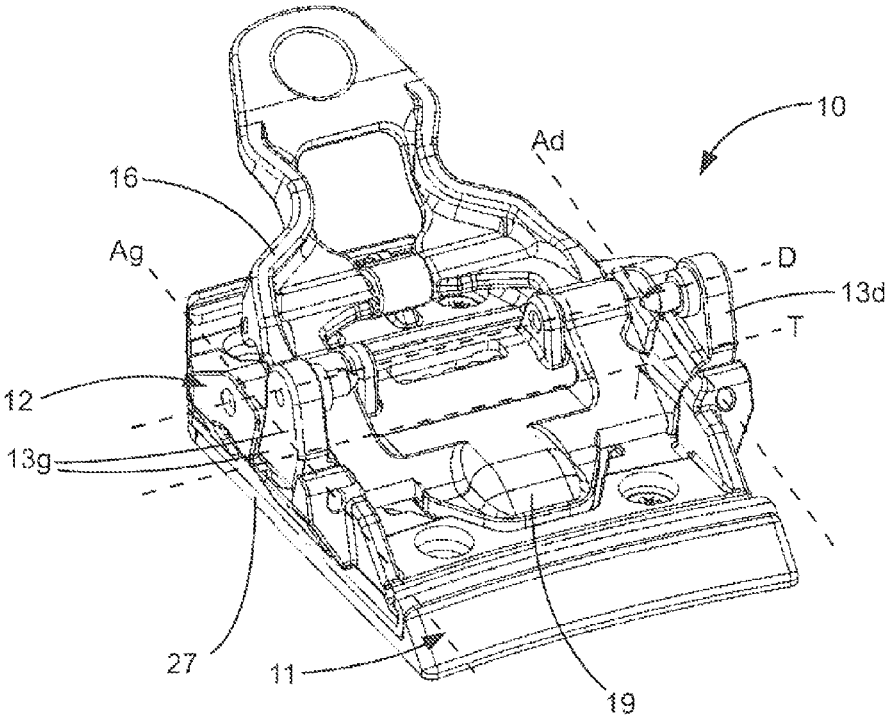
Figure 3:
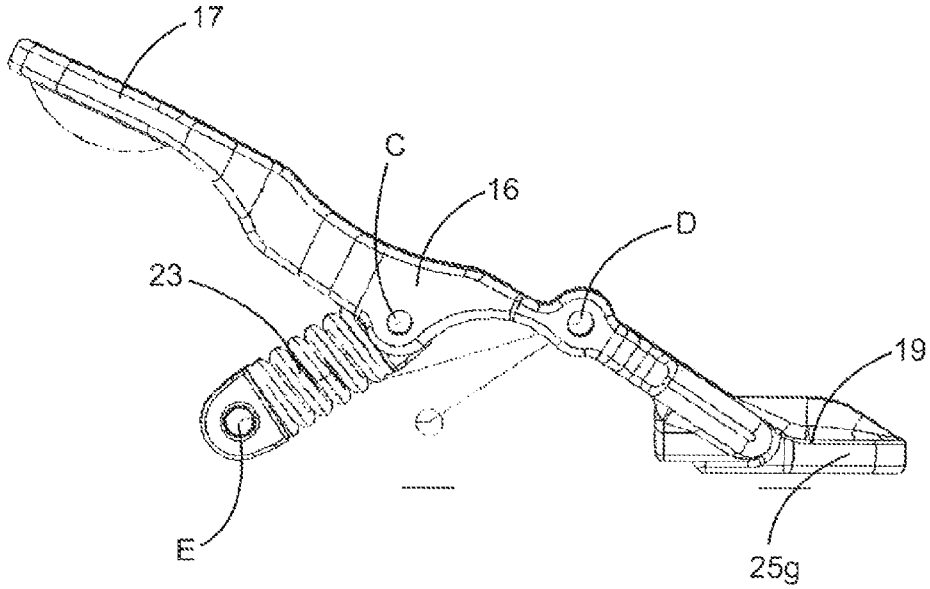
Figure 4:
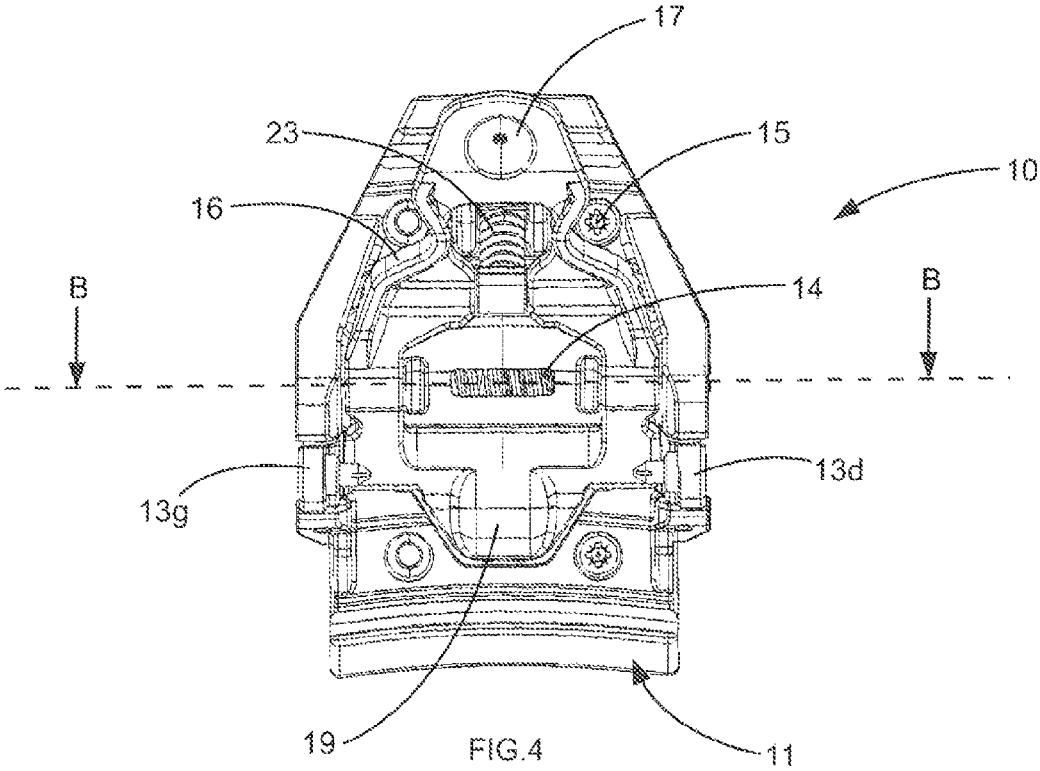
Figure 5:
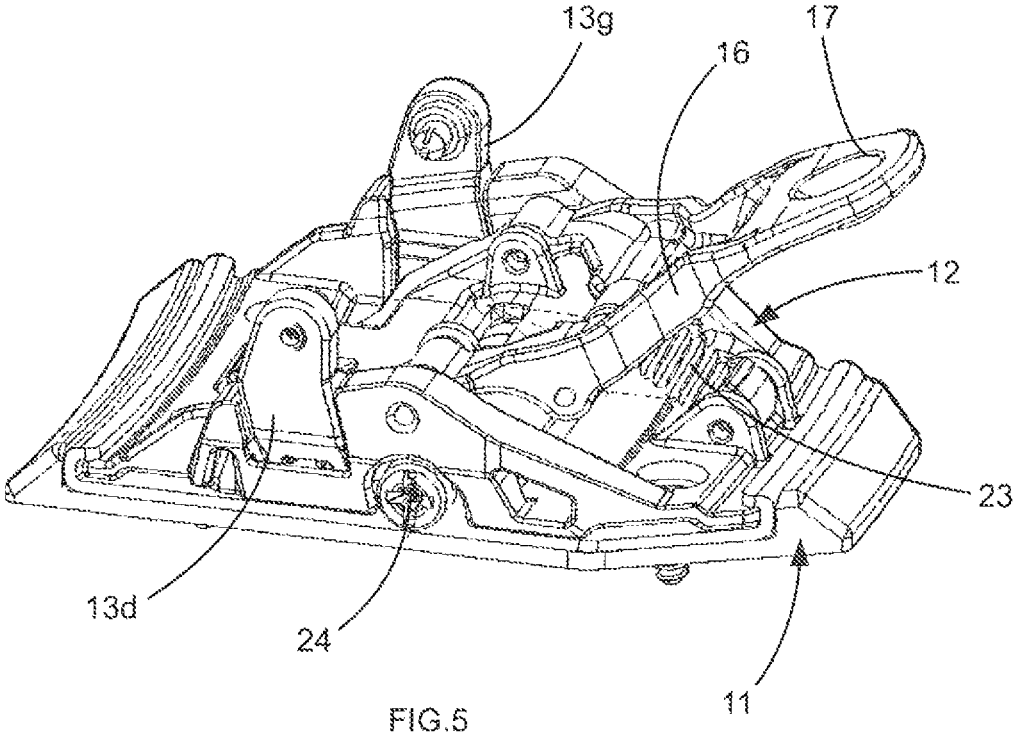

| | | | | |
|---|---|---|---|---|
| 2011/0298196 | A1* | 12/2011 | Lehner | 280/611 |
| 2013/0087992 | A1* | 4/2013 | Ibach et al. | 280/626 |
| 2013/0207356 | A1* | 8/2013 | Barthel et al. | 280/11.33 |
| 2013/0285352 | A1* | 10/2013 | Lehner et al. | 280/611 |
| 2013/0307252 | A1* | 11/2013 | Crema et al. | 280/617 |
| 2013/0328289 | A1* | 12/2013 | Vailli et al. | 280/625 |
| 2014/0110919 | A1* | 4/2014 | Convert | 280/615 |
| 2014/0159345 | A1* | 6/2014 | Indulti | 280/614 |

FOREIGN PATENT DOCUMENTS

| | | | | | |
|---|---|---|---|---|---|
| EP | 2 353 673 | A | | 8/2011 | |
| EP | 2 431 080 | A | | 3/2012 | |
| WO | WO2007010392 | | * | 7/2006 | A63C 9/02 |

* cited by examiner

TOEPIECE WHICH RELEASES AUTOMATICALLY AS A RESULT OF TWISTING

BACKGROUND

1. Field of the Invention

The invention relates to a toepiece of a binding device for securing a boot to a gliding board. This toepiece is particularly suitable for ski touring. It also relates to a binding device for securing a boot to a gliding board and to a gliding board as such equipped with such a binding device and/or such a toepiece.

2. Related Art

The document EP-A1-2353673 describes a toepiece of a binding device for securing a boot to a touring ski. The front binding of the boot is based on two jaws of the toepiece that are articulated about longitudinal pivot axes with respect to a base of the toepiece that is intended to be fixed to the touring ski. Each jaw comprises retaining elements that are intended to engage with the touring ski boot. The two jaws are articulated by way of a spring system in order to take up a first stable position, known as the closed position, in which the retaining elements engage with corresponding hollow parts formed laterally in the anterior part of the touring ski boot, in order to fix the boot, only allowing it to move in rotation about a transverse axis with respect to the ski, and a second stable position, known as the open position, in which the jaws are spaced apart such that the retaining elements free the boot, which can be separated from the touring ski. The front part of the boot is secured to a touring ski equipped with such a toepiece by positioning the boot such that the two jaws take up the second, open position, then by pressing strongly with the heel of the boot on the spring-based system, thereby allowing the articulated jaws to move towards their first, closed position in which they move towards the boot in order to position the retaining elements within complementary hollow parts of the boot.

A drawback with such existing toepieces is their lack of safety in the case of the skier falling, in particular in the case of a twisting fall on the part of the skier in a downhill situation of the alpine skiing type, involving a twisting movement of the boot with respect to the ski, during which the boot remains trapped in the toepiece, thereby risking injury to the skier.

A known manner for automatically freeing the touring boot in order to prevent injury to the skier is to provide a heel piece which is associated with such existing toepieces, is intended to fix the rear part of the touring boot and is configured so as to be able to free the boot in the event of a fall, in particular as a result of twisting, but also as a result of a forward fall and/or a backward fall. However, such heel pieces are complex, resulting in higher costs and substantial weight, and are unable to comply with safety criteria dictated by the alpine standard ISO9462. This limits the safety imparted to the touring skier.

The document EP-B1-1393783 describes another type of toepiece comprising jaws that are likewise articulated about longitudinal axes on a transversely mobile part. The jaws are in contact with a tilter which prevents the jaws from tilting while the movement travel of the mobile part is less than a given travel. Next, the jaws tilt and free the boot. However, this solution is complex, bulky and heavy on account of the existence of the tilter.

The document EP-A1-2431080 describes a toepiece having a fixed part and a mobile part that rotates about a vertical axis. The mobile part comprises two jaws that are conventionally connected by a knuckle joint mechanism having a lever, said jaws being integral with the mobile part. The lever selectively changes between a lowered position in which the toepiece is placed in an open position in which the jaws are spaced apart to allow the boot to be fitted in the toepiece, a semi-raised position in which the jaws are moved towards one another in order to place the toepiece in a closed position suitable for downhill use and a raised position in which locking elements that are integral with the lever are in contact with a cam surface that is integral with the fixed part in order to prevent any possibility of the lever returning towards the semi-raised position and towards the lowered position, thereby making it possible to prevent any releasing of the jaws and freezing the toepiece in a walking position. In the closed position of the toepiece, which is taken up in the semi-raised position of the lever, the mobile part can pivot over a predetermined limited angular travel, this pivoting taking place counter to the action of a return spring for returning the mobile part towards a centred position. In the walking position of the toepiece, which is taken up in the raised position of the lever, the lever is placed between lateral arms that are integral with the fixed part, thereby preventing the mobile part from pivoting with respect to the fixed part. In the event of a fall, in a first phase the heel is released in the region of the heel piece. This allows the entire boot to move. During this movement, the boot rotates the mobile part with respect to the fixed part until it comes into abutment at the end of its predetermined travel. This thus results in the mobile part suddenly stopping. In a second phase, the continuation of the movement of the boot on account of the fall, while the mobile part is in angular abutment, causes one of the jaws to be pushed, thereby causing the jaws to open and the lever to pass into its lowered position, freeing the boot. Thus, releasing takes place in two phases: in the first phase, during the rotation of the mobile part, the jaws are blocked in the closed position and retain the boot in the toepiece, whereas in the second phase, which starts when the mobile part comes into angular abutment, the jaws begin to open under the action of the boot and place the lever in the lowered position. However, this solution is again complex, bulky and heavy. The safety imparted is somewhat unsatisfactory, since releasing requires a very large angular movement of the boot.

SUMMARY OF THE DISCLOSURE

The aim of the present invention is to propose a solution for securing a boot to a gliding board which remedies the drawbacks listed above.

In particular a first object of the present invention is to provide a simple, fairly compact, economical and lightweight solution for securing a boot.

A second object of the present invention is to provide a solution for securing a boot that ensures optimum safety for the skier in the event of a fall and limits as far as possible the risks of material deterioration.

In particular, the invention aims to propose a toepiece that allows releasing as a result of twisting associated with a heel piece designed to release only as a result of a forward fall.

The present toepiece is intended in particular to comply with both the touring standard ISO13992 and the alpine standard ISO9462.

These aims may be achieved by way of a toepiece for a binding device for securing a boot to a gliding board, comprising a fixed part which is intended to be secured to the gliding board, and a mobile part which is mounted on the fixed part with a possibility of relative movement with at least one transverse component and on which two jaws are mounted so as to pivot about a substantially longitudinal axis, the toepiece comprising a lever that is actuable from the outside of the toepiece and takes up a blocking position in which blocking elements that are integral with the lever prevent the jaws from tilting so as to keep the toepiece in a closed configuration in which the jaws retain the boot, the toepiece comprising releasing elements that cooperate with the blocking elements such that the execution of said movement of the mobile part beyond a predetermined travel with respect to the fixed part causes the lever to pass automatically, in particular from the blocking position, towards a freeing position which is different from the blocking position and in which the blocking elements allow the jaws to tilt.

In this context, it may be advantageous to provide that:

- the jaws are able to rotate on a mobile base of the mobile part, the transverse movement of which takes place counter to a force of a first return spring, returning the mobile part towards a rest position,
- the blocking elements take up a first position in which they prevent the jaws from pivoting under the effect of a second return spring different from the first return spring,
- and the releasing elements cooperate with the blocking elements such that the execution of said transverse movement beyond a predetermined travel causes the blocking elements to automatically pass, counter to the action of the second return spring, from the first position towards a second position in which the blocking elements allow the jaws to pivot so as to allow the jaws to open and to free the boot.

Preferably, the system for mounting the mobile part on the fixed part is such that the sliding movement of the mobile part with respect to the fixed part takes place along a rectilinear path, which is in particular oriented substantially in the transverse direction, or along a curvilinear path with at least one component mainly in the transverse direction, said curvilinear path being in particular approximately or exactly circular, delimiting a portion of a circle, the centre of which is intended to be located close to the heel of the boot.

The system for mounting the mobile part on the fixed part may comprise guiding elements of the slide type that ensure that a mobile base of the mobile part is mounted on a fixed base of the fixed part so as to slide by translation. Alternatively, the system for mounting the mobile part on the fixed part may comprise two mutually parallel links that are arranged in the manner of a deformable parallelogram ensuring that a mobile base of the mobile part is mounted on a fixed base of the fixed part so as to move in circular translation.

The blocking elements may in particular be mounted in an articulated manner, in particular a rotary manner, with respect to the mobile part in order to change between a first position, which is taken up in the blocking position of the lever and in which they block the jaws and the toepiece in its closed configuration, and a second position, different from the first position, which is taken up in the freeing position of the lever and in which they allow the jaws to tilt, and the releasing elements may cooperate with the blocking elements such that the execution of said movement of the mobile part beyond the predetermined travel with respect to the fixed part causes the blocking elements to pass automatically from their first position to their second position.

The lever may be mounted in an articulated manner on the mobile part.

The toepiece may comprise a knuckle joint mechanism provided with a fitting/removal spring that acts on the lever and is configured such that the blocking position and the freeing position are stable positions at the ends of an overall tilting travel of the lever, said travel including an unstable intermediate position of the lever corresponding to a hard point of inflection of the knuckle joint.

Preferably, the releasing elements may comprise first and second bearing surfaces, which are respectively integral with the mobile and fixed parts, one in contact with the other, undergoing relative sliding one on the other during the execution of said movement of the mobile part, the first and second bearing surfaces being shaped such that this relative sliding causes the lever to move from its blocking position towards its freeing position.

The first bearing surface may be carried by the blocking elements that are integral with the lever.

One of the first and second bearing surfaces is preferably formed by a protrusion and the other of the first and second bearing surfaces by a hollow into which the protrusion penetrates prior to said movement of the mobile part and which is shaped such that the protrusion moves progressively out of the hollow during the relative sliding of the first and second bearing surfaces, such that the lever passes from its blocking position towards its freeing position.

The hollow may be integral with the lever and the protrusion is integral with the fixed part, but a reverse arrangement may be provided.

The toepiece may comprise a fitting pedal that is integral with the lever and the hollow may be formed in the fitting pedal.

The toepiece may comprise at least one releasing spring which is interposed between the fixed and mobile parts and urges the mobile part into a determined rest position with respect to the fixed part.

The toepiece may comprise a means for setting the stiffness of the releasing spring.

The blocking elements may be acted upon by a return spring which is independent of the releasing spring and urges the blocking elements towards a position, in particular said first position, in which they prevent the jaws from pivoting and block the toepiece in its closed configuration.

The toepiece may comprise elastic elements that urge the jaws to perform a tilting movement that tends to place the toepiece in a fitting configuration.

It may be ensured that, in the fitting configuration, the angular position taken up by the jaws is an intermediate position between the angular positions taken up in the closed configuration and the releasing configuration of the toepiece.

The blocking elements may be formed by lateral flanks of the lever which, in the blocking position of the lever, bear against bearing surfaces that are integral with the jaws, in particular on their inner face.

These aims may also be achieved by way of a toepiece for a binding device for securing a boot to a gliding board, comprising a fixed part which is intended to be secured to the gliding board, and a mobile part which is mounted on the fixed part with a possibility of relative movement with at least one transverse component, the toepiece having:

- jaws that are able to rotate on a mobile base of the mobile part, the transverse movement of which takes place counter to a force of a first return spring, returning the mobile part towards a rest position,
- blocking elements which take up a first position in which they prevent the jaws from pivoting under the effect of a second return spring different from the first return spring,
- and releasing elements that cooperate with the blocking elements such that the execution of said transverse movement beyond a predetermined travel causes the blocking elements to automatically pass, counter to the action of the second return spring, from the first position towards a second position in which the blocking elements allow the jaws to pivot so as to allow the jaws to open and to free the boot.

The system for mounting the mobile part on the fixed part may be such that the sliding movement of the mobile part with respect to the fixed part takes place along a rectilinear path, which is in particular oriented substantially in the transverse direction, or along a curvilinear path having at least one component mainly in the transverse direction, said curvilinear path being in particular approximately or exactly circular, delimiting a portion of a circle, the centre of which is intended to be located close to the heel of the boot.

The blocking elements may be mounted in an articulated manner, in particular a rotary manner, with respect to the mobile part such that the blocking elements pass from the first position to the second position and vice versa by the blocking elements pivoting with respect to the mobile part about an axis directed in the transverse direction.

The releasing elements may comprise first and second bearing surfaces, which are respectively integral with the mobile and fixed parts, one in contact with the other, undergoing relative sliding one on the other during the execution of said movement of the mobile part, the first and second bearing surfaces being shaped such that this relative sliding causes the blocking elements to pass from their first position towards their second position.

A binding device for securing a boot to a gliding board may comprise such a toepiece, which is intended to secure a front part of the boot, and also a heel piece which is intended to secure a rear part of the boot to the gliding board, the heel piece being designed to release the boot only in the case of a forward fall of the skier, the boot being released from the binding device in the case of a fall with a twisting movement of the boot only by way of the toepiece.

Finally, a gliding board, in particular touring ski, may comprise such a toepiece and/or such a binding device.

BRIEF DESCRIPTIONS OF THE DRAWINGS

Figure 14:
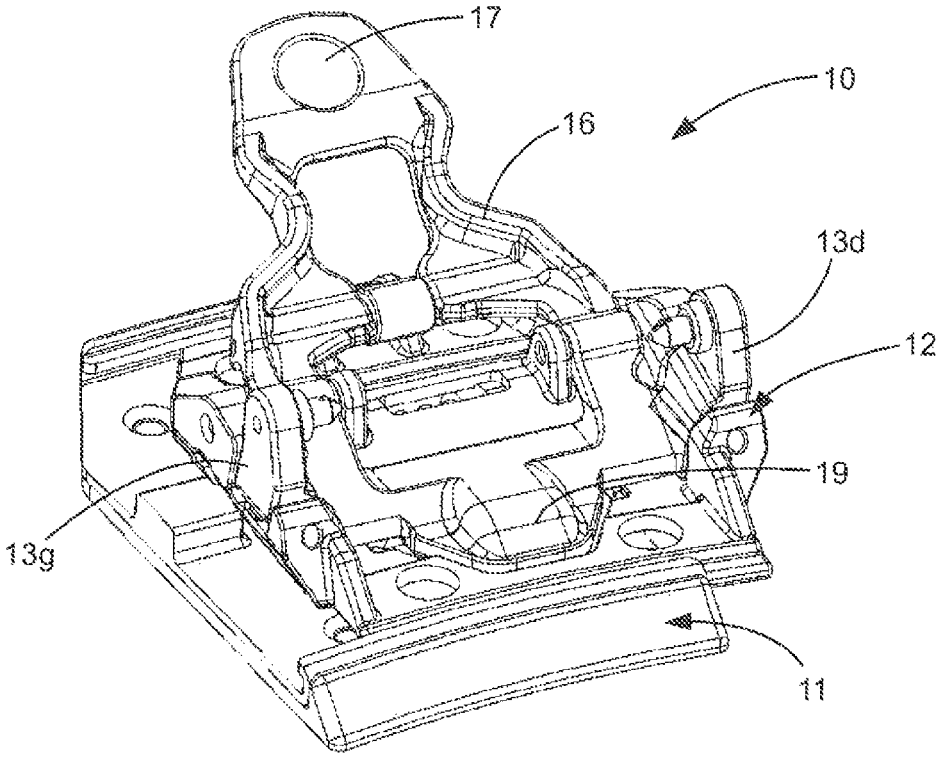
Figure 15:
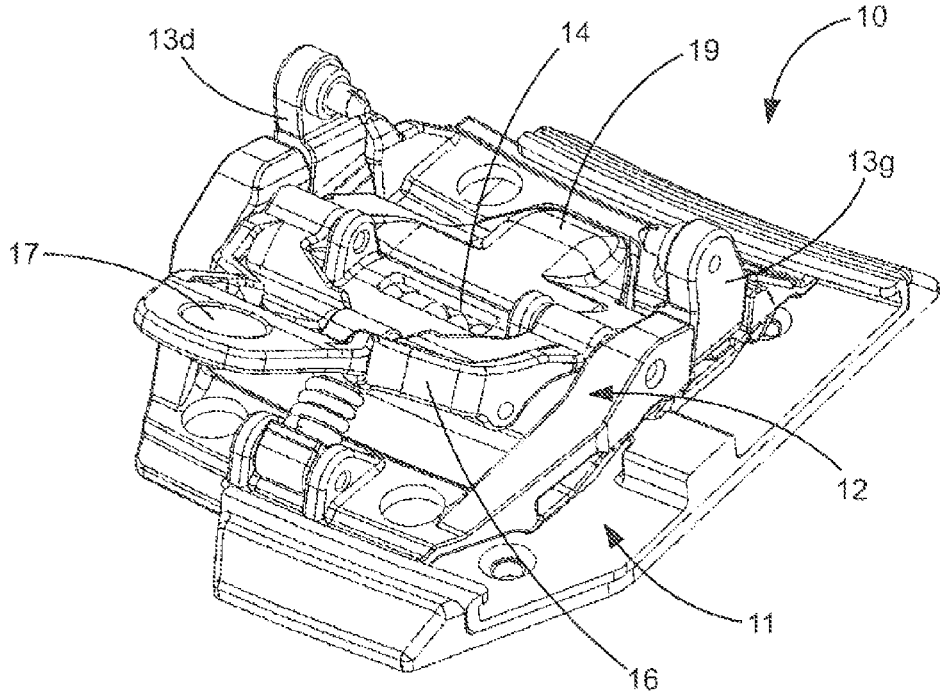
Figure 16:
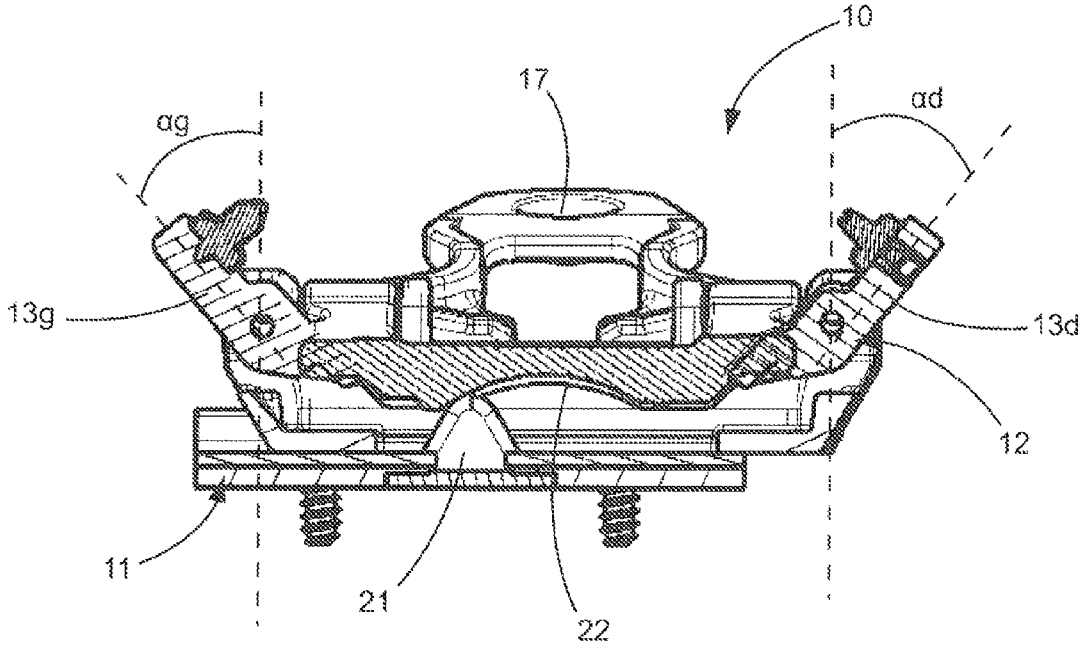
Figure 17:
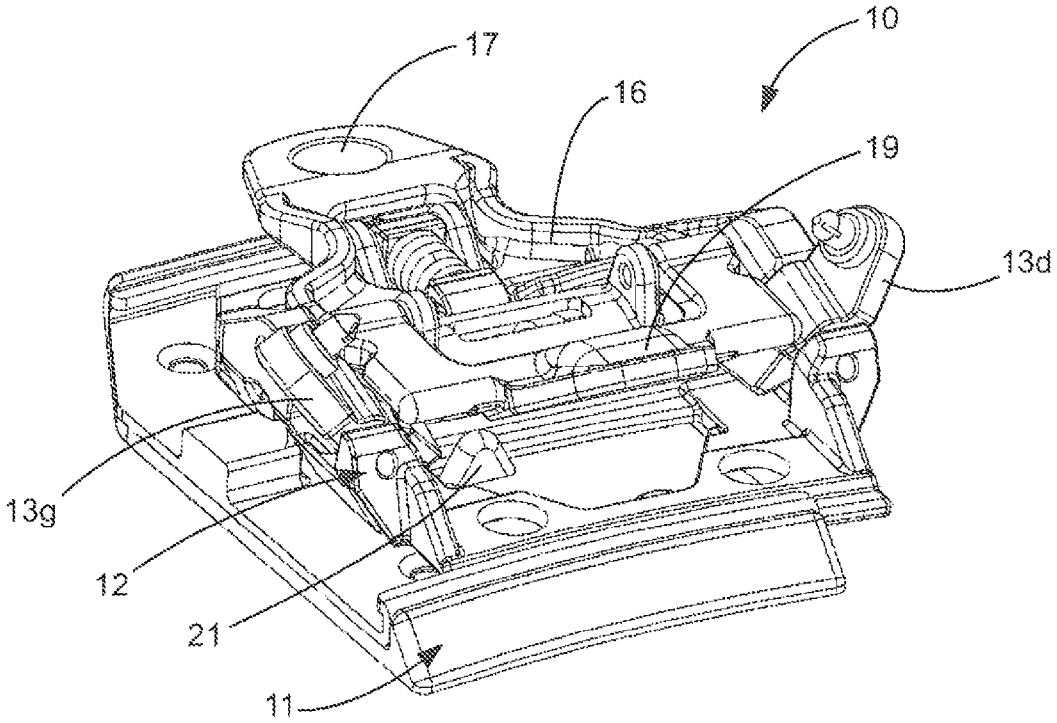
Figure 18:
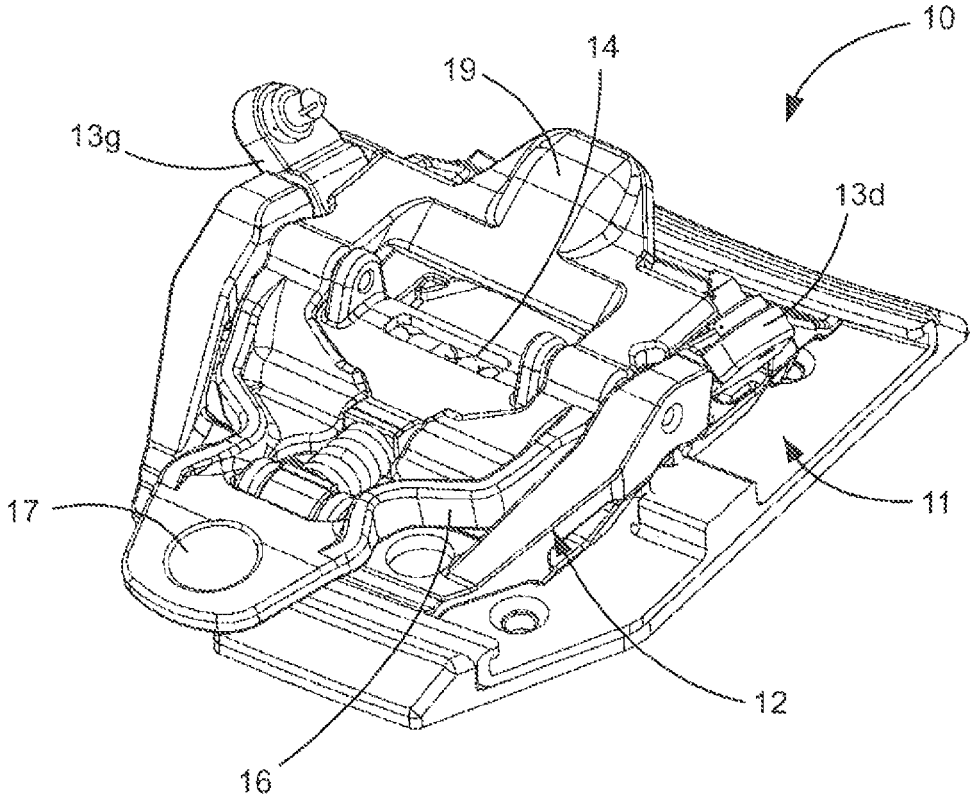
Figure 19:
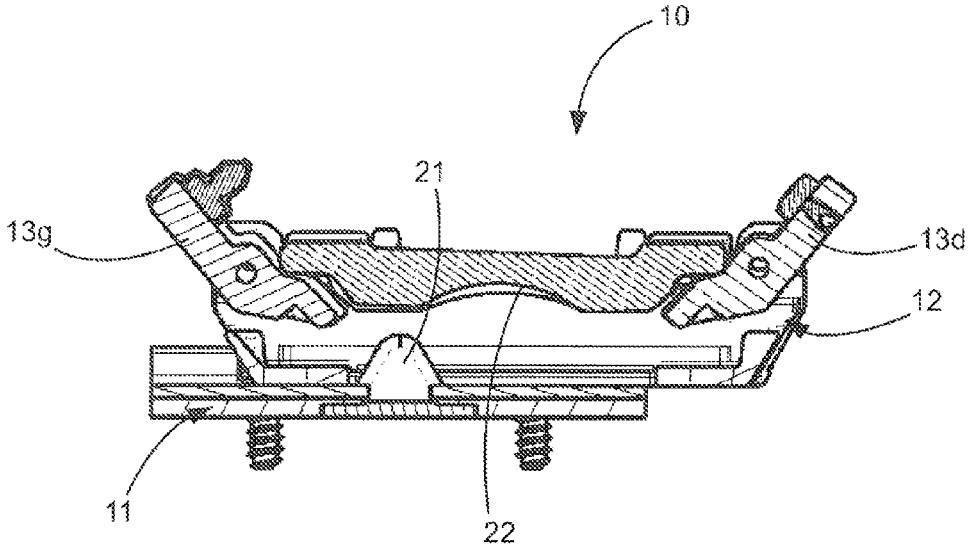
Figure 23:
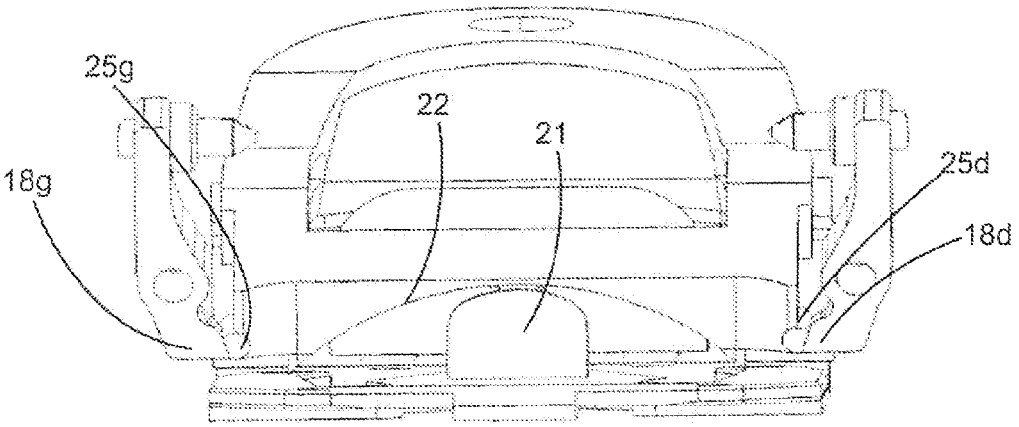
Figure 24:
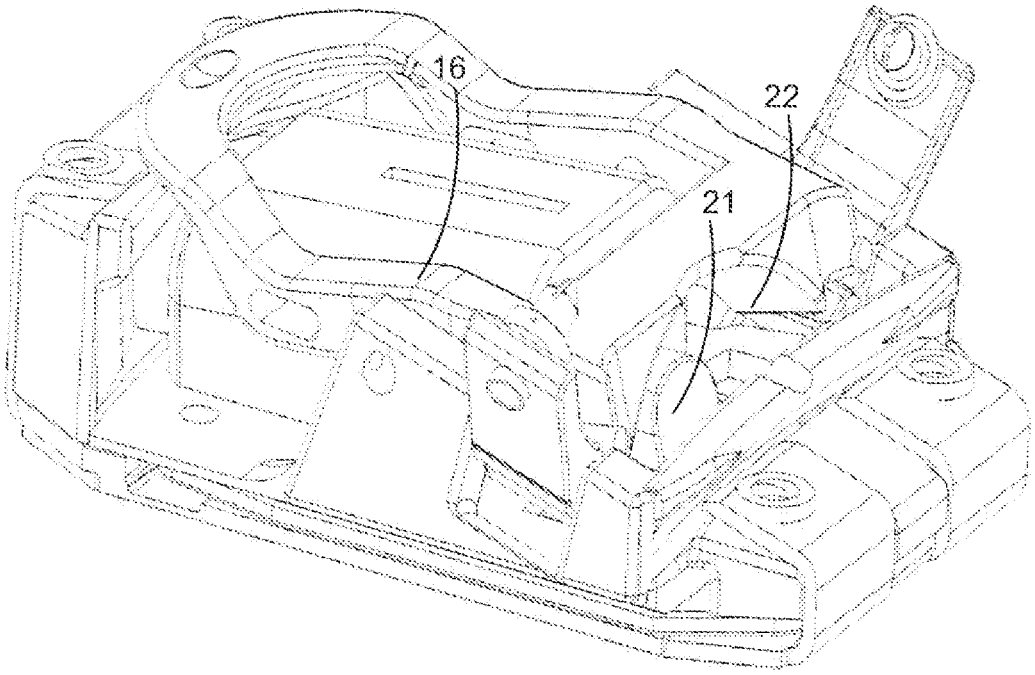
Figure 25:
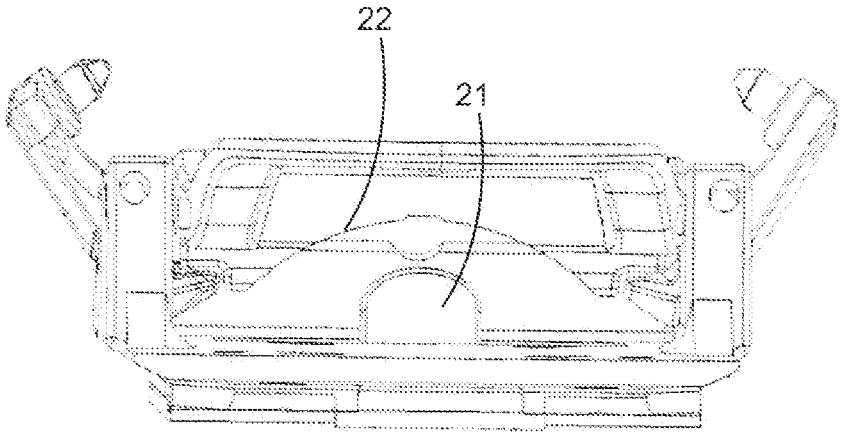
Figure 26:
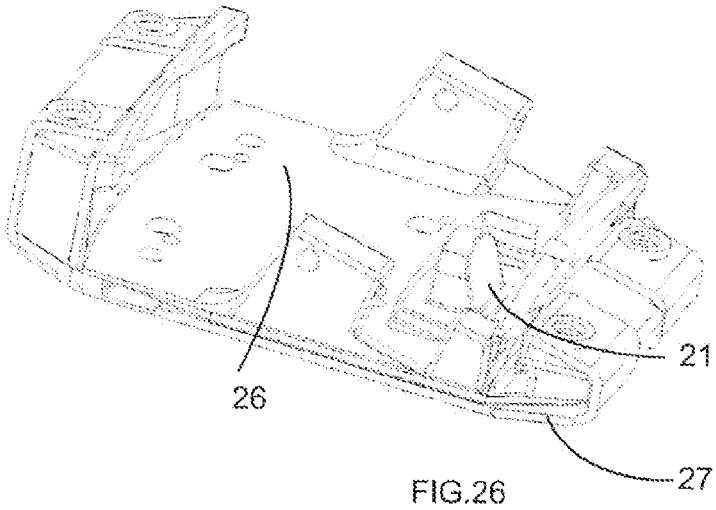
Figure 27:
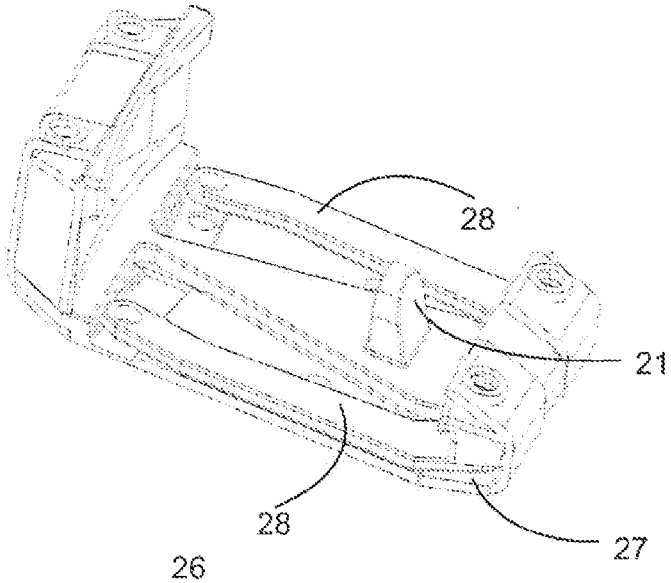
Figure 28:
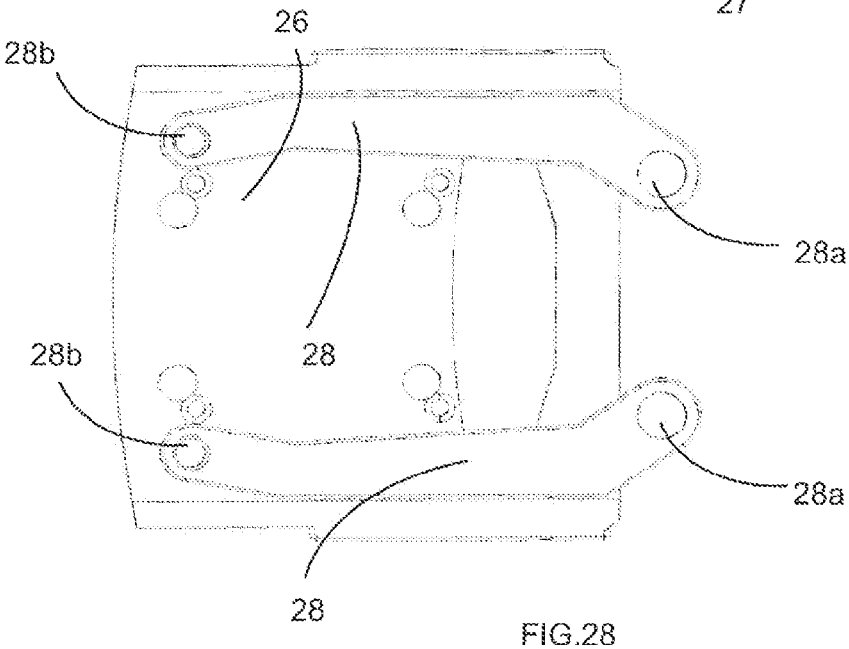
Figure 29:
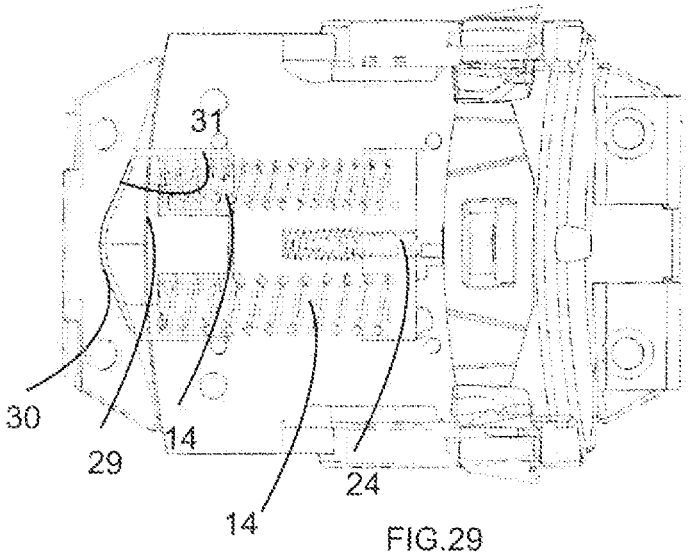

Further advantages and features will become more clearly apparent from the following description of particular embodiments of the invention which are given by way of nonlimiting example and are shown in the appended drawings, in which:

FIGS. 1 to 9 illustrate a first embodiment of a toepiece according to the invention in a closed configuration, FIGS. 10 to 13 illustrate the toepiece from the preceding figures in a fitting configuration, FIGS. 14 to 16 illustrate the toepiece from the preceding figures during the passage from the closed configuration to a configuration for releasing as a result of twisting, FIGS. 17 to 19 illustrate the toepiece from the preceding figures in the configuration for releasing as a result of twisting, FIGS. 20 to 23 illustrate a second embodiment of a toepiece according to the invention, in its closed configuration, FIGS. 24 and 25 illustrate the toepiece from FIGS. 20 to 23 in its fitting configuration, FIGS. 26 to 28 show the system for mounting the mobile part on the fixed part of the toepiece according to the second embodiment, and FIG. 29 shows the releasing system interposed between the mobile and fixed parts of the toepiece according to the second embodiment.

DETAILED DESCRIPTION

The following description relates to a toepiece 10 of a binding device for securing a boot to a gliding board (not shown). This toepiece 10 secures the front part of the boot and is particularly suitable for ski touring, but does not exclude use in the context of alpine skiing and/or cross-country skiing. More generally, the toepiece 10 is involved in the formation of the binding device for securing the boot to the gliding board, in combination with a rear heel piece (not shown) that secures the rear part of the boot. FIGS. 1 to 19 illustrate a first embodiment of such a toepiece 10. FIGS. 20 to 29 illustrate a second embodiment of such a toepiece 10. For reasons of simplification, the reference numerals have been retained from one embodiment to the other for functional elements that have the same function in both embodiments.

To make it easier to understand the rest of the description, an orthonormal frame of reference is associated with the toepiece 10, the longitudinal direction X of the toepiece 10 being the horizontal direction oriented from the rear to the front of the toepiece 10. The transverse direction Y thereof corresponds to the horizontal direction perpendicular to the X direction and is oriented from the right to the left of the toepiece 10. The vertical direction Z is perpendicular to the horizontal plane defined by the X and Y directions and is oriented towards the top of the toepiece 10.

A "toepiece" should be understood as being the front part of the binding device for securing the boot to the gliding board, this front part engaging with the front region of the boot in order to retain it, whether this be with a possibility of angular pivoting of the boot about an axis directed in the transverse direction, or not.

The toepiece 10, which thus belongs to the binding device for securing the boot to the gliding board, comprises a fixed part 11 intended to be fixed to the gliding board (for example by way of securing screws 15), a mobile part 12 mounted on the fixed part 11 with a possibility of relative movement with at least one transverse component. This may be in particular a possibility for the mobile part 12 to slide or move in translation with respect to the fixed part 11 along a rectilinear path (referenced "T" in FIG. 2), in particular oriented substantially in the Y direction, or along a curvilinear path (referenced "C" in FIG. 21) with at least one component mainly in the Y direction. In particular, it may be a substantially or exactly circular path delimiting a portion of a circle, the centre of which is intended to be located close to the heel of the boot. In each of the first and second embodiments, the system for mounting the mobile part 12 on the fixed part 11 is configured so as to allow these movements of the mobile part 12 along the paths T or C. It will be easily understood here that the nature of these movement possibilities is different from a circular pivoting movement.

In the first embodiment, in order to form the system for mounting the mobile part 12 on the fixed part 11, a mobile base 26 of the mobile part 12 is mounted so as to slide with respect to a fixed base 27 of the fixed part 11 by way of guide elements of the slide type that ensure a possibility of movement in translation, for example having a rectilinear, transversely directed form. These guide elements may be in the form of elements having a complementary shape that are carried by the fixed and mobile bases, respectively.

Figure 6:
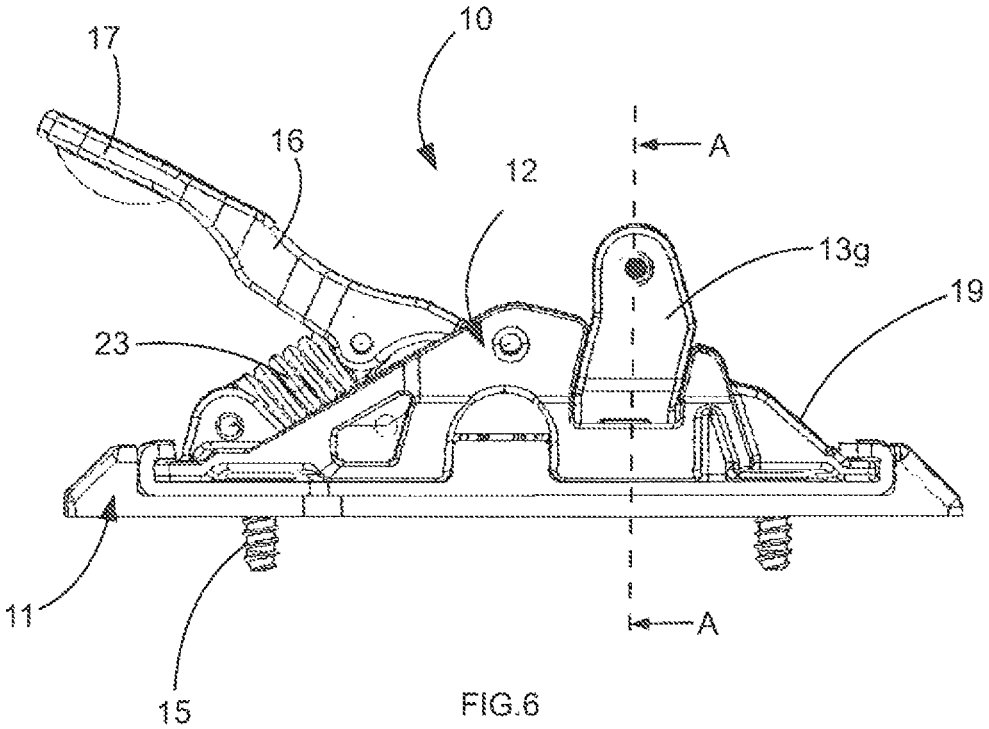
Figure 7:
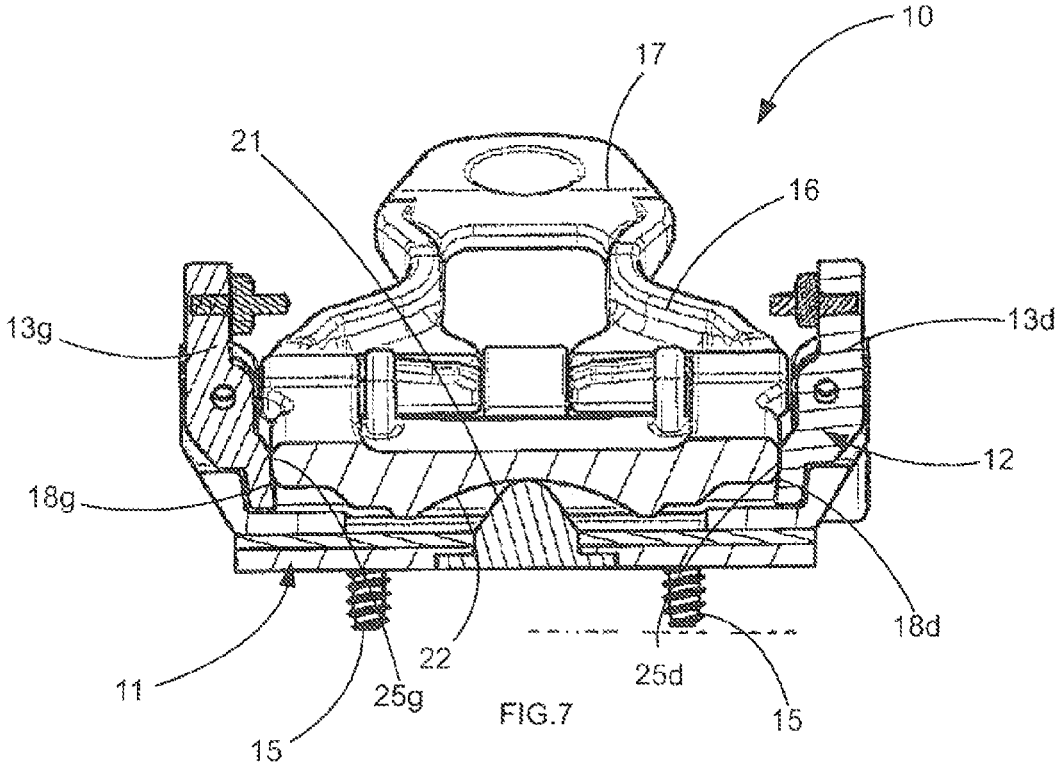
Figure 8:
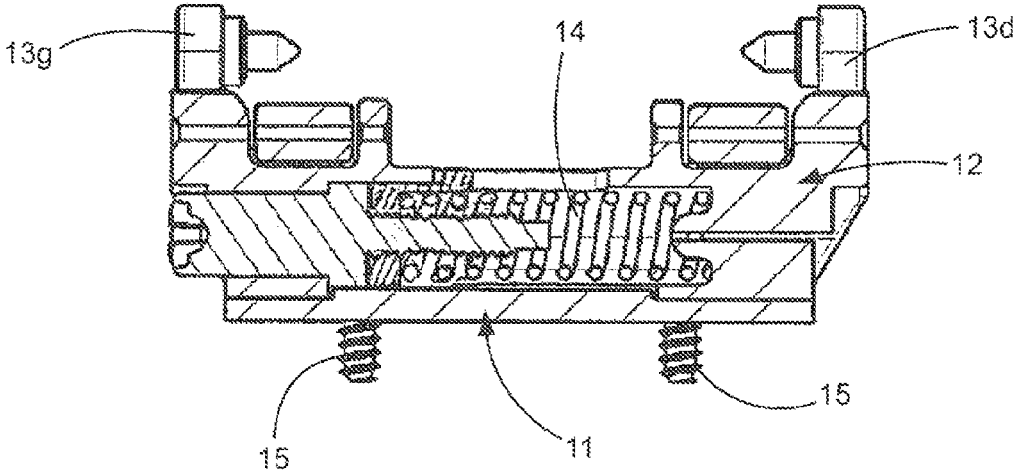
Figure 9:
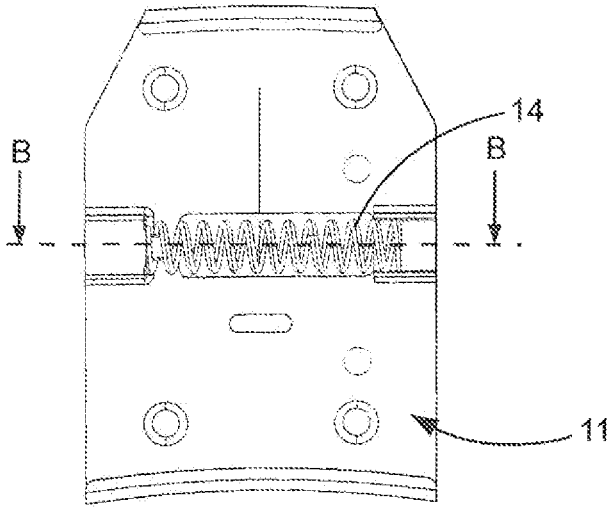
Figure 10:
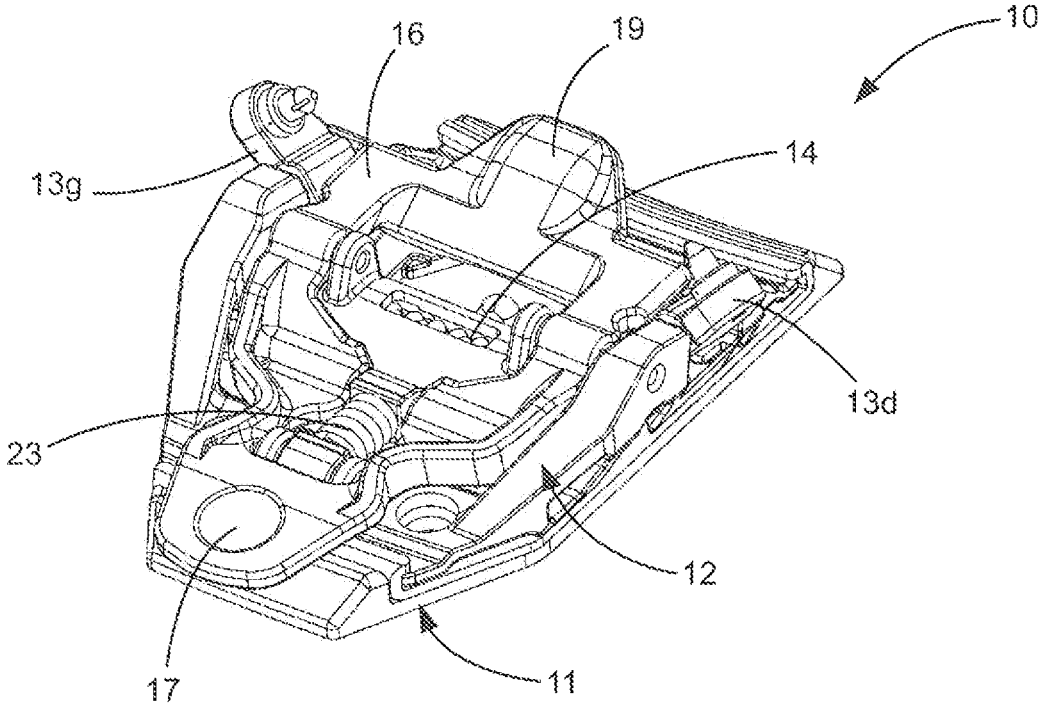
Figure 11:
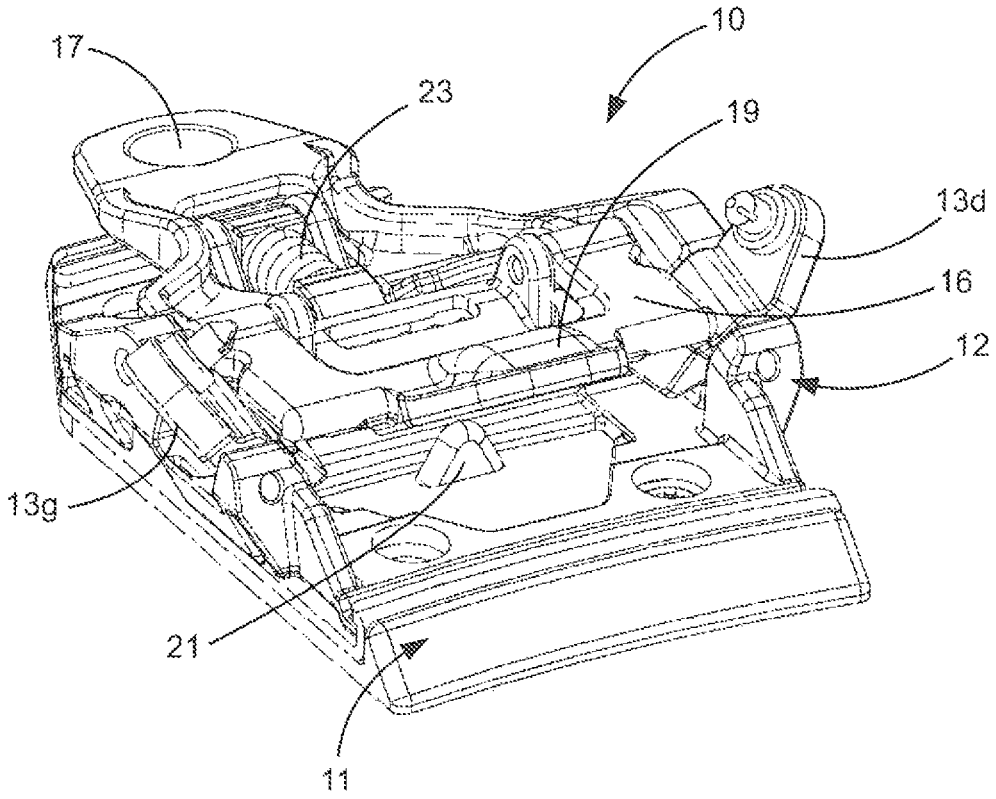
Figure 12:
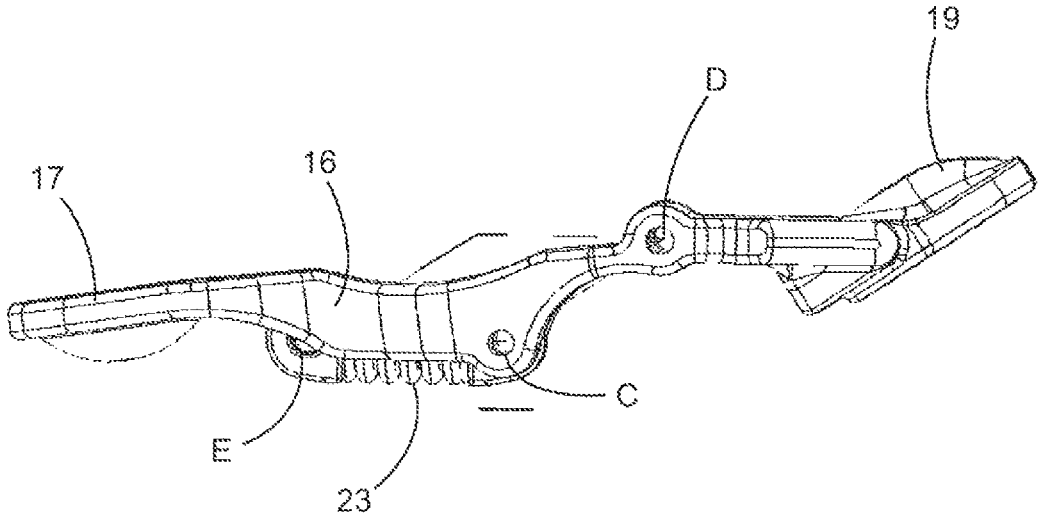
Figure 13:
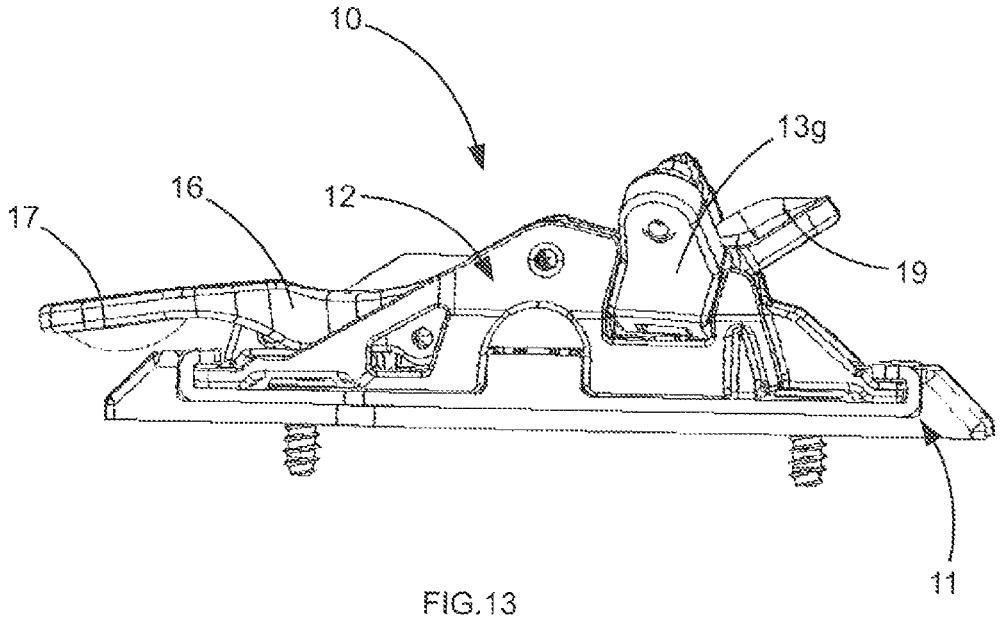

FIGS. 7, 16 and 19 are sectional views of the toepiece 10 on a section plane A-A which is oriented in the Y, Z directions, passing through the two jaws 13*d*, 13*g*, and is visible in FIG. 6, which is a side view from the left (along Y) of the toepiece 10. FIG. 8 is a sectional view of the toepiece 10 on a section plane B-B which is oriented in the Y, Z directions, passing through a releasing spring 14 described below, and is visible in FIGS. 4 and 9, which are a top view along Z of the toepiece 10 and a bottom view along Z of the fixed part 11, respectively.

The toepiece 10 comprises two rigid jaws 13*d*, 13*g*, respectively on the left and right, which are offset in the Y direction with respect to one another. Since the toepiece 10 is generally symmetrical on either side of a mid-plane of symmetry (X, Z) indices "d" and "g" are added to the references of certain elements of the right-hand part and of the left-hand part, respectively, of the toepiece 10. The jaws 13*g*, 13*d* have retaining elements 20*d*, 20*g* that are intended to retain the boot when the toepiece is in a closed configuration, described below. These retaining elements 20*d*, 20*g* are for example in the form of spikes that are intended to be inserted into lateral openings provided in the boot. The jaws are mounted so as to pivot about respective substantially horizontal axes Ad, Ag (see FIG. 2) which are oriented substantially in the longitudinal direction X of the toepiece 10. Each of the jaws 13*d*, 13*g* is contained in the plane of its movement by tilting, the planes of movement of the two jaws 13*d*, 13*g* being otherwise coincident in a single plane which is oriented in particular in the Y and Z directions. The pivot axis Ad, Ag of each of the jaws 13*d*, 13*g* is fixed in a frame of reference linked to the mobile part 12 of the toepiece 10, such that the pivot axes of the jaws are able to move with respect to the gliding board in the same manner as the mobile part 12, in particular in the Y and possibly Z and/or X directions. Each pivot axis Ad, Ag may be parallel to the longitudinal direction X or contained in a plane (X, Z), forming an angle of more or less 10 degrees with respect to the horizontal. Each axis Ad, Ag may in particular be advantageously inclined downwardly along Z, running towards the rear of the toepiece 10 along X, so as to favour the removal of the boot after freeing, explained below, in a configuration for releasing as a result of twisting that is explained in detail below.

As a result, each jaw 13*d*, 13*g* can tilt, in its plane of movement, over an overall angular travel respectively referenced $\alpha d$, $\alpha g$ in FIG. 16, between a closed position (for example illustrated in FIG. 7 for each of the two jaws 13*d*, 13*g*) corresponding to a position of the jaw in which it is moved as close as possible to the other jaw over this overall angular travel, and an open position (for example illustrated in FIGS. 19 and 16 for each of the two jaws 13*d*, 13*g*) corresponding to a position of the jaw in which it is spaced apart as far as possible from the other jaw over this overall angular travel. The two jaws 13*d*, 13*g* are independent such that each of the jaws can adopt its open or closed position independently of the position adopted by the other jaw. The passage from one position to the other is realized by the jaw 13*g*, 13*d* tilting about its pivot axis Ag, Ad over the entire overall angular travel, which is advantageously greater than 30 degrees, in particular greater than 40 degrees, so as to provide an opportunity for releasing the boot as a result of twisting in the event of large transverse forces applied by the boot to at least one of the jaws, in particular in the event of a fall involving a twisting movement of the boot, so as to allow the removal of the boot from the left-hand side or the right-hand side of the toepiece 10.

The toepiece 10 comprises a lever 16 which is actuable manually or with a stick, from outside the toepiece 10, between:

- a blocking, or locking, position (FIG. 3) in which it prevents the jaws 13*d*, 13*g* from tilting about the axes Ad, Ag in order to keep the toepiece 10 in the closed configuration (FIGS. 1 to 9) in which the jaws 13*d*, 13*g* are in the closed position and retain the boot by virtue of the retaining elements 20*d*, 20*g*,
- and a freeing, or unlocking, position (FIG. 12) in which the lever 16 and the retaining elements 20*d*, 20*g* are disengaged from the boot in order to allow the jaws 13*d*, 13*g* to tilt towards the open position about the axes Ad, Ag.

In the blocking position taken up by the lever 16 in FIGS. 1 to 9 and in FIGS. 14 and 15, the lever 16 prevents the tilting movement of the two jaws 13*d*, 13*g* towards their open positions and, on the contrary, blocks them in their closed positions. By contrast, when it is in the freeing position, which is the case in FIGS. 10 to 13 following a voluntary action on the part of the user on an actuating element 17 described in more detail below or following an automatic action via releasing elements following sufficient movement of the mobile part 12 with respect to the fixed part, the lever 16 allows the two jaws 13*d*, 13*g* to pass from their closed positions towards their open positions, and vice versa.

To this end, each jaw 13*d*, 13*g* comprises a bearing surface, respectively 18*d*, 18*g*, located in the lower part of the corresponding jaw, in particular below the pivot axis Ad, Ag corresponding to this jaw and on their inner faces. These bearing surfaces are visible in FIG. 7, are opposite one another in the transverse direction and are intended to engage by contact with the blocking elements that are integral with the lever 16. The blocking elements are, for example, formed respectively by two lateral flanks 25*d*, 25*g*, for example formed in the lever 16 by being delimited by the lever 16 itself. The blocking elements and the bearing surfaces are shaped such that the bearing surfaces 18*d*, 18*g* are in contact with the flanks 25*d*, 25*g* of the lever 16 when it takes up the blocking position in order to prevent the tilting of the jaws 13*d*, 13*g* towards the open position. This is the situation shown in FIGS. 7 and 23. By contrast, contact between the bearing surfaces 18*d*, 18*g* and the lateral flanks 25*d*, 25*g* of the lever 16 that are constituent parts of the blocking elements that are integral with the lever 16 is eliminated when the lever 16 is in its freeing position, this allowing each jaw 13*d*, 13*g* to tilt from the closed position towards the open position or vice versa from the open position towards the closed position. These bearing surfaces 18*d*, 18*g* may be approximately vertical and advantageously have a slight transverse inclination along Y towards the outside of the toepiece 10, extending upwardly along Z. The inclination angle between the bearing surface 18*d*, 18*g* and the vertical direction Z may be around 5 degrees. This makes it possible to reduce mechanical friction between the lateral flanks 25*d*, 25*g* of the lever 16 and the bearing surfaces 18*d*, 18*g* of the jaws while the lever 16 passes towards its freeing position. This also makes it possible to automatically adapt the vertical position taken up by the lever 16 when it is in its blocking position, depending on the actual height and/or the actual width of the sole of the boot.

However, the nature of the blocking elements may be different from that described above, since the blocking function described is fulfilled in particular depending on the way in which the jaws are mounted on the mobile part 12.

In the two embodiments, the blocking elements 25*d*, 25*g* are described as integral with the lever 16 in that they are produced from the same material as the rest of the lever so as to form a one-piece lever or in that they are mounted on the lever 16 in a fixed manner or with an optional possibility of moving with respect to the rest of the lever 16, for example by articulation, depending on the requirements.

The toepiece 10 comprises releasing elements, described in more detail below, that cooperate with the blocking elements, that is to say in this case the lateral flanks 25*d*, 25*g*, such that the execution of the at least transverse movement of the mobile part 12 beyond a predetermined travel with respect to the fixed part 11 causes the lever 16 to automatically pass towards the freeing position. In other words, the execution of the movement of the mobile part 12 beyond this predetermined travel with respect to the fixed part 11, this movement resulting from the boot applying releasing forces as a result of twisting to at least one of the jaws 13*d*, 13*g*, has the effect of causing the lever 16 to pass from its blocking position to its freeing position. By contrast, within this predetermined travel, the lever 16 remains in its blocking position and keeps the jaws 13*d*, 13*g* in their closed positions, which continue to retain the front part of the boot. The predetermined travel is in particular between around 5 and 15 mm and is in particular approximately equal to around 10 mm.

In addition, the toepiece 10 is configured such that the tilting of at least one of the jaws 13*d*, 13*g*, this tilting being allowed by the blocking elements in the freeing position of the lever 16 which is automatically taken up following the at least transverse movement of the mobile part 12, causes the toepiece 10 to pass into what is known as the configuration for releasing as a result of twisting. In this configuration for releasing as a result of twisting, the toepiece is such that the boot is freed from the jaws 13*d*, 13*g* under the effect of the boot applying releasing forces as a result of twisting to said jaw 13*d*, 13*g*. In other words, tilting of at least one of the jaws 13*d*, 13*g* following the movement of the mobile part 12 beyond the predetermined travel with respect to the fixed part 11 allows the toepiece 10 to pass from the closed configuration towards the configuration for releasing as a result of twisting, automatically freeing the boot from the jaws if the boot applies releasing forces as a result of twisting to at least one of the jaws. The position taken up by said at least one jaw which has tilted into the releasing configuration corresponds to the open position defined above.

Moreover, tilting of the jaws 13*d*, 13*g* following a voluntary actuation of the lever 16 by the user from its blocking position towards its freeing position, by said user manually applying forces to the actuating element 17 of the lever 16, allows the toepiece 10 to pass from the closed configuration towards what is known as a fitting configuration that allows the boot to be positioned between the jaws 13*d*, 13*g*. The position adopted by the jaws in the fitting configuration may be the open position or an intermediate angular position between the extreme open and closed positions defined above. Therefore, in the fitting configuration, the angular position taken up by the jaws may thus be an intermediate position between the angular positions taken up in the closed and releasing configurations of the toepiece 10, avoiding a need to space apart the jaws beyond requirements in order to position the boot between them.

In other words, when the lever 16 is in the blocking position in the manner illustrated at least in FIGS. 1 to 9 in order to block the toepiece 10 in its closed configuration, it may then be positioned in its freeing position:

- either by means of the user voluntarily applying forces to the lever 16 in the region of the actuating element 17 in order to position the toepiece 10 in the fitting configuration for which no movement of the mobile part 12 is necessary (this is then the configuration shown in FIGS. 10 to 13),
- or, when the mobile part 12 is moved along the path T over a travel greater than the predetermined travel mentioned above with respect to the fixed part 11, under the effect of the boot applying transverse forces to at least one of the jaws during a fall involving twisting of the boot: the toepiece 10 is then automatically placed in the configuration for releasing as a result of twisting, in the manner shown in FIGS. 17 to 19.

FIGS. 14 and 15 show the toepiece 10 while it is passing towards the configuration for releasing as a result of twisting, before the lever 16 has freed the jaws 13*d*, 13*g* and thus before the latter have begun to tilt, while FIG. 16 shows the toepiece 10 while it is passing towards the configuration for releasing as a result of twisting, when the lever 16 has begun to free the jaws 13*d*, 13*g* and thus when the latter have begun to tilt, but before the lever 16 has reached its freeing position.

Specifically, the closed configuration of the toepiece 10 corresponds to a state of the latter in which each of the two jaws 13*d*, 13*g* is positioned in its closed position.

Thus, the configuration for releasing as a result of twisting is automatically taken up in the event of a twisting fall, whether or not this is of the purely twisting type, that is to say is possibly combined with a forward fall and/or a backward fall of the skier.

The above description of the configuration for releasing as a result of twisting should be interpreted as implying that the angular tilting travel of at least one jaw 13*d*, 13*g* between the closed configuration of the toepiece 10 and the configuration thereof for releasing a result of twisting is such that the boot can escape from the space between the jaws 13*d*, 13*g* by a movement of the boot that has at least one component in the transverse direction Y, optionally associated with an upwardly directed vertical component along Z. This angular tilting travel may advantageously be greater than around 30 degrees, in particular greater than 45 degrees, for example approximately equal to 55 degrees, such that in the configuration for releasing as a result of twisting, the boot can escape freely from the space between the jaws 13*d*, 13*g* by the boot moving substantially horizontally in the longitudinal direction X and transverse direction Y, passing over at least one jaw 13*d*, 13*g*, in particular over the jaw tilted into the open position under the effect of the transverse twisting forces applied by the boot after the lever 16 has passed towards the freeing position, this being brought about automatically by the movement of the mobile part 12 with respect to the fixed part 11.

The toepiece 10 may comprise, in each of its first and second embodiments, elastic elements (not shown) that urge the jaws 13*d*, 13*g* to perform a tilting movement that tends to place the toepiece 10 in the fitting configuration. Each elastic element may in particular be in the form of a torsion spring that urges the jaws 13*d*, 13*g* to perform a tilting movement that tends to move them away from the closed configuration of the toepiece 10. In other words, each elastic element associated with a given jaw tends to urge this jaw to perform a tilting movement in a pivoting direction that runs from the closed position towards the open position of the jaw.

However, these arrangements are only optional in that such an elastic element may be absent. Specifically, the toepiece 10 may be designed such that the passage of each jaw from its closed position to its open position may result:

- from an effect of gravity applied to the jaws for the passage towards the configuration for releasing as a result of twisting or towards the fitting configuration,
- and/or from the effect of transverse forces applied by the boot during a transverse movement of the latter for the passage towards the configuration for releasing as a result of twisting,
- and/or from the effect of transverse forces applied by the boot during a vertical movement of the latter for the passage towards the fitting configuration.

In these latter variants, the lever 16 prevents any tilting of the jaws 13*d*, 13*g* towards their open positions that is likely to arise under the effect of gravity and/or under the effect of transverse forces applied by the boot during its vertical movement during the fitting of the boot into the end piece and/or under the effect of the transverse forces applied by the boot during the transverse movement of the mobile part 12 during a twisting fall and/or under the effect of the abovementioned elastic elements. This blocking action of the lever 16 is realized by its blocking elements, which are formed here by the lateral flanks 25*d*, 25*g* which bear against the bearing surfaces 18*d*, 18*g* while the lever 16 is in the blocking position. The lever 16 then allows this tilting of the jaws under the effect of these various types of forces as soon as it takes up the freeing position that accompanies the separation of the contact between the bearing surfaces 18*d*, 18*g* and the blocking elements that are integral with the lever 16.

The lever 16 is mounted in an articulated manner on the mobile part 12 and is for example articulated in front of the jaws 13*d*, 13*g* in the longitudinal direction X and is designed so as to vary the position by way of a tilting movement about a pivot axis referenced "D", which is for example oriented parallel to the transverse direction Y. However, it remains conceivable for the lever 16 to be mounted, in particular in an articulated manner, on the fixed part of the toepiece 10.

The lever 16 may comprise a fitting pedal 19, on a rear side with respect to the axis D, that is designed to form an abutment for the boot in the vertical direction Z such that a downwardly directed movement of the boot in the direction of the fixed part 11 and thus in the direction of the gliding board in the vertical direction Z, in particular during the fitting of the boot into the retaining elements 20*d*, 20*g* that are integral with the jaws, causes the lever 16 to tilt towards the blocking position in which it keeps the toepiece 10 in its closed configuration on account of its action of blocking the jaws 13*d*, 13*g* in their closed positions in the region of their bearing surfaces 18*d*, 18*g* by virtue of the blocking elements formed in this example by the lateral flanks 25*d*, 25*g* of the lever. This tilting movement of the lever 16 towards the blocking position automatically entrains the return of each jaw towards its closed position. In other words, the blocking elements 25*d*, 25*g* are formed by lateral flanks of the lever 16 which, in the blocking position of the lever 16, bear against bearing surfaces 18*d*, 18*g* that are integral with the jaws 13*d*, 13*g*, in particular on their inner face.

The fitting pedal 19 is also configured so as to form an abutment along Z such that tilting of the lever 16 towards its freeing position, resulting from the passage of the toepiece 10 from the closed configuration towards the configuration for releasing as a result of twisting, causes the boot to be lifted by the fitting pedal 19 upwardly in the vertical direction Z in a direction away from the gliding board so as to make it easier to interrupt the engagement between the boot and the retaining elements 20*d*, 20*g* carried by the jaws 13*d*, 13*g*. The bearing surface 18*d*, 18*g*, which is carried by each jaw which tilts while passing towards the configuration for releasing as a result of twisting, under the effect of transverse forces applied by the boot to this jaw during a transverse movement of the boot and of the mobile part 12, is involved, on account of its contact with the lever 16, in the tilting of the lever 16 towards its freeing position.

On the other side, the lever 16 comprises the abovementioned actuating element 17, which is disposed on a front side with respect to the axis D and is intended to allow the application of forces that are mainly oriented in the Z direction to the lever 16. These are manual forces or forces applied by way of a stick. The arrangement of the actuating element 17 is such that the application of these forces causes the lever 16 to tilt towards the freeing position, in which it allows the toepiece 10 to pass towards its fitting configuration and thus allows the jaws 13*d*, 13*g* to tilt in the direction of their open positions, in particular allows the jaws 13*d*, 13*g* to pass towards their intermediate position between the angular positions taken up in the closed configuration and releasing configuration of the toepiece 10.

Generally, the releasing elements comprise first and second bearing surfaces that are respectively integral with the mobile part 12 and the fixed part 11. The first and second bearing surfaces are in contact with one another and undergo relative sliding one on the other during the execution of the movement of the mobile part 12 from its rest position along the path T when transverse forces are applied by the boot to one jaw during a transverse movement of the boot during a fall of the skier that involves twisting of the boot. The first and second bearing surfaces are shaped such that this relative sliding causes the lever 16 to pass from its blocking position towards its freeing position.

In the embodiment illustrated, which has the advantage of its simplicity, one of the first and second bearing surfaces is formed by a protrusion 21 and the other of the first and second bearing surfaces is formed by a hollow 22 into which the protrusion 21 penetrates prior to the movement of the mobile part 12 from its rest position and which is shaped such that the protrusion 21 moves progressively out of the hollow 22 during the relative sliding of the first and second bearing surfaces, such that the lever 16 passes from its blocking position towards its freeing position.

In the two embodiments illustrated where the lever 16 is integral with the mobile part 12, the hollow 22 is integral with the lever 16, in particular by being formed in the fitting pedal 19 which is itself integral with the lever 16 in the case of the first embodiment, while the protrusion 21 is integral with the fixed part 11.

These arrangements are visible in FIGS. 7, 16 and 19. In FIG. 7, the protrusion 21 is penetrating into the hollow 22 while the movement of the mobile part 12 has not yet taken place, that is to say while the toepiece 10 is in its closed configuration and in its fitting configuration. The hollow 22 and the protrusion 21 are shaped such that the protrusion 21 moves progressively out of the hollow 22 during the relative sliding of the protrusion 21 with respect to the hollow 22, such that the lever 16 passes from its blocking position towards its freeing position. In FIG. 16, the protrusion 21 has already slid with respect to the hollow 22 and is very close to its peripheral edge. The lever 16 has not yet tilted towards its freeing position, it has just undergone tilting about the axis D resulting from the lifting effect applied by the protrusion 21. By contrast, in FIG. 19, the protrusion 21 has moved outside the hollow 22, clearing the peripheral edge of the hollow 22, this movement having caused the lever 16 to tilt from its position in FIG. 16 towards its freeing position.

A reverse organization is entirely conceivable, in which the protrusion 21 is integral with the mobile part 12 while the hollow 22 is formed in the fixed part 11.

The toepiece 10 according to the first embodiment comprises a knuckle joint mechanism (visible in FIGS. 3 and 12) that acts on the lever 16 and is configured such that the blocking position and the freeing position are stable positions at the ends of an overall tilting travel of the lever, said travel including an unstable intermediate position of the lever corresponding to a hard point of inflection. The term "stable" means that it is a position that is adopted naturally in the absence of external forces applied to the lever in the region of the fitting pedal 19 and in the region of the actuating element 17. This knuckle joint mechanism comprises for example a fitting/removal spring 23, the ends of which are mounted in an articulated manner about axes C, E on the lever 16 and on the mobile part 12, respectively. The hard point of inflection corresponds to an organization (not shown) in which the axes C, D and E are aligned, in which the compression of the fitting/removal spring 23 is at a maximum. By contrast, the stable blocking and freeing positions respectively shown in FIGS. 3 and 12 correspond to an organization in which the axes C, D and E are not aligned (the axis C being respectively above or below the straight line passing through the axes E and D) and in which the compression of the fitting/removal spring 23 is at a minimum.

The first and second bearing surfaces, that is to say in this case the protrusion 21 and the hollow 22, are shaped such that their relative sliding during the movement of the mobile part 12 has the effect of causing the lever 16 to tilt about an angular travel that runs from the stable blocking position towards a position located between the hard point of inflection and the stable freeing position. Thus, following the movement of the mobile part 12 beyond the predetermined travel, this having the effect of causing the lever 16 to tilt towards the unstable intermediate position, it is the action of the knuckle joint mechanism on the lever 16 which causes the latter to tilt from the unstable intermediate position towards the stable freeing position, in order to place the toepiece 10 in its configuration for releasing as a result of twisting.

The hollow 22 may have any desired shape as long as it is suitable for the provision of a function as explained above. In the variant shown, the hollow 22 has a profile, seen in section (Y, Z), in the form of a circular arc which ensures that the movement of the lever 16 is progressive during the movement of the mobile part 12 and is involved in an effect of realigning the mobile part 12 towards its rest position, explained below. However, in its central part, the profile of the hollow 22, seen in section (Y, Z), may be different, for example in the form of a horizontal flat along Y. This makes it possible to ensure that when the protrusion 21 is in abutment against said flat, the lever 16 is not urged towards its freeing position.

The first and second bearing surfaces, that is to say in this case the protrusion 21 and the hollow 22, may, however, be shaped such that their relative sliding during the movement of the mobile part 12 has the effect of causing the lever 16 to tilt over its overall angular travel running from the stable blocking position towards the stable freeing position.

As indicated above, the toepiece 10 comprises a releasing spring 14, which is interposed between the mobile and fixed parts 12, 11 and urges the mobile part 12 into a determined rest position with respect to the fixed part 11. In the first embodiment, the releasing spring 14 extends along an axis oriented substantially in the transverse direction Y of the toepiece, which also comprises a means 24 (FIG. 5) for setting the stiffness of the releasing spring 14, for example with the aid of a screw/nut system that is accessible in a transverse direction Y from one of the sides of the toepiece 10. The fitting configuration of the toepiece 10 corresponds to an organization of the toepiece 10 in which the mobile part 12 is in its rest position and at the same time the jaws are in their open positions. By contrast, the transverse movement of the mobile part 12 from its rest position while the toepiece 10 passes towards the configuration for releasing as a result of twisting, under the effect of transverse forces applied by the boot to one of the jaws during a transverse movement of the boot in the event of the skier falling with a twisting movement, is accompanied by progressive compression of the releasing spring 14, which tends to return the mobile part 12 towards its rest position as soon as these forces stop.

At the time of fitting and of removal by way of the voluntary action of the user on the lever 16, only the spring 23 of the knuckle joint mechanism is stressed. The forces necessary for this action are advantageously low, in particular less than around 110 N, and are constant however the binding is set in accordance with alpine standard ISO9462. In particular, they are independent of the setting of the stiffness of the releasing spring 14. During the automatic return phase of the mobile part 12 towards its rest position following a releasing configuration, only the stiffness of the releasing spring 14 takes action on account of the fact that the spring 23 of the knuckle joint mechanism is then stressed very little if at all. During releasing, as the mobile part 12 moves and the lever 16 tilts, the two springs 14 and 23 are stressed and are involved in the definition of the force threshold for releasing the toepiece.

Finally, as indicated above, the binding device for securing the boot to the gliding board comprises both such a toepiece 10, intended to secure the front part of the boot, and a heel piece (not shown) intended to secure a rear part of the boot to the gliding board. By virtue of the arrangement of a toepiece 10 as described above, the releasing of the boot from the binding device in the event of a twisting fall can advantageously be realized only by way of the toepiece 10. Thus, the heel piece can be designed to release the boot only in the event of a forward fall of the skier, and not to release as a result of twisting. Even in the context of ski touring, the use of a simple heel piece becomes possible, resulting in a lower cost and lower weight of the binding device compared with the prior art. This favours the performance of the touring ski, for which the overall weight is currently an essential criterion.

Figure 20:
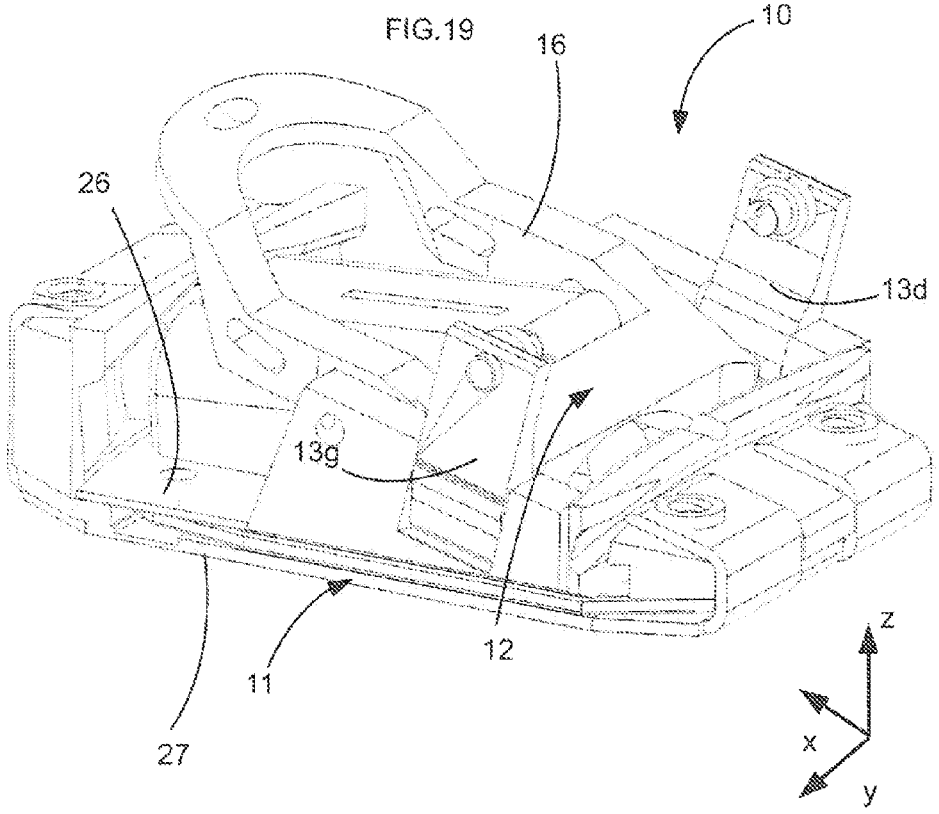
Figure 21:
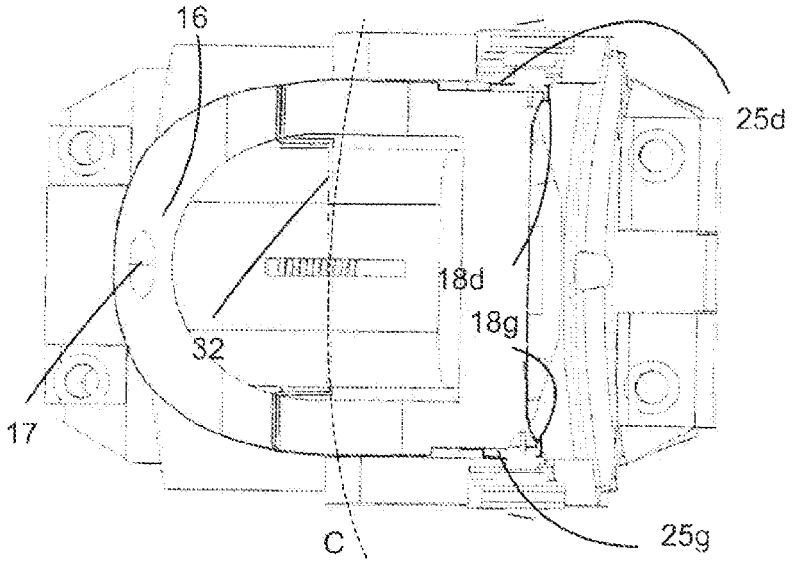
Figure 22:
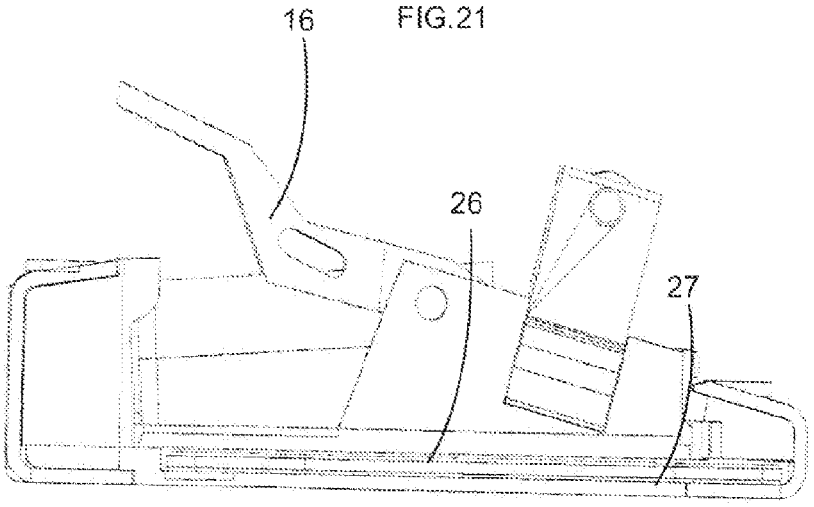

The second embodiment is illustrated in FIG. 20 and the subsequent figures.

A first difference relates to the nature of the system for mounting the mobile part 12 on the fixed part 11 of the toepiece 10. In the second embodiment, in order to form the system for mounting the mobile part 12 on the fixed part 11, the mobile base 26 of the mobile part 12 is mounted so as to move in circular translation with respect to the fixed base 27 of the fixed part 11 by way of two mutually parallel links 28 that are arranged in the manner of a deformable parallelogram. Each link 28 comprises a first end 28*a* articulated on the fixed base 27, and a second end 28*b*, opposite the first end 28*a*, articulated on the mobile base 26. The articulation movement of the two links 28 with respect to the mobile and fixed bases provides a possibility of movement in curvilinear translation, in particular circular translation, directed transversely. The path of the mobile part is referenced C in FIG. 21.

A second difference resides in the elimination of the fitting pedal 19 and of the knuckle joint mechanism that are used in the first embodiment. The lever 16 and its operating principle with respect to the blocking elements 25*d*, 25*g* and the jaws 13*d*, 13*g* are retained but the way in which it is mounted on the rest of the mobile part 12 is different. A return spring 32 permanently urges the lever 16 towards its blocking position, in which the blocking elements 25*d*, 25*g* that are integral with the lever 16 prevent the jaws 13*d*, 13*g* from tilting, by way of their contact with the bearing surfaces 18*d*, 18*g*. The return spring 32 (FIG. 21) consists for example of at least one torsion spring that has at least one first spur linked to the lever 16, in particular with a possibility of relative sliding of the first spur with respect to the body of the lever 16, and at least one second spur linked to the mobile base 26 of the mobile part 12. In order to allow the lever 16 to be tilted towards its freeing position from the blocking position, for example at the time of fitting, it is suitable to press the actuating element 17 manually, with a boot or with one's stick. By taking up the freeing position, the lever 16 makes it possible to move the blocking elements 25*d*, 25*g* towards a position in which they allow the jaws 13*d*, 13*g* to pivot. Thus, this voluntary pivoting of the lever 16 places the toepiece 10 in its fitting configuration, the jaws being sufficiently open towards the outside of this toepiece to allow the boot to be positioned between the retaining elements 20*d*, 20*g*. It should be noted therefore that, unlike the function provided by the knuckle joint mechanism in the first embodiment, the freeing position of the lever 16 in the second embodiment is an unstable position. The fitting operation is very easy to carry out without it being necessary to overcome a significant force, on account of the fact that the user counters the low force of the return spring 32 acting on the lever 16. In the second embodiment, only the blocking position of the lever 16 is a stable position, being continually urged towards this position by the return spring 32, which can also have any other nature than that described above, as long as the desired function is fulfilled.

With reference to FIGS. 26 to 29, a third difference resides in the organization of the releasing spring 14, which has a different nature from that employed in the first embodiment. As indicated above, the toepiece 10 comprises at least one releasing spring 14. In the particular example illustrated, two such springs 14 are interposed between the mobile and fixed parts 12, 11 and urge the mobile part 12 into a determined rest position with respect to the fixed part 11. The two releasing springs 14 are parallel and extend, in the second embodiment, along an axis that is oriented substantially in the longitudinal direction X of the toepiece 10. The two springs 14, which are integral with the mobile part 12, act longitudinally upon a piston 29 that belongs to the mobile part and is movable in the longitudinal direction X with respect to the mobile base. The piston 29, which is arranged on the front side of the toepiece 10 along X, while the releasing elements are arranged on the rear side of the toepiece along X, has a first, convex bearing surface 30, in the form of a dome for example. The first bearing surface 30 is in permanent contact with a second bearing surface 31 carried by the fixed part 11, but with a possibility of relative sliding between the bearing surfaces 30, 31 in the transverse direction Y. The shape of the second bearing surface 31 is concave and substantially complementary to that of the first bearing surface 30. The shape of these surfaces 30, 31, for example in the form of ramps, on either side of the longitudinal mid-axis in the transverse direction makes it possible to set the realignment of the mobile part 12 of the toepiece 10 transversely and also the shape of the releasing curve of the toepiece 10. The rest position of the mobile part 12 corresponds to the position adopted by the mobile part 12 when the first bearing surface 30 is housed and centred transversely in the bottom of the cavity delimited by the second bearing surface 31. This is the position normally adopted outside situations in which the mobile part 12 moves transversely and the toepiece 10 releases automatically.

The fitting configuration of the toepiece 10 corresponds to an organization of the toepiece 10 in which the mobile part 12 is in its rest position as above and at the same time the jaws are in their open positions. It is adopted by lowering the lever 16 towards its freeing position. By contrast, the transverse movement of the mobile part 12 from its rest position while the toepiece 10 passes towards the configuration for releasing as a result of twisting, under the effect of the transverse forces applied by the boot to one of the jaws during transverse movement of the boot in the event of the skier falling with a twisting movement, is accompanied by relative sliding of the surfaces 30, 31 and progressive compression of the two releasing springs 14 in the longitudinal direction X by way of the piston 29, which tends to return the mobile part 12 towards its rest position as soon as these efforts stop. The second embodiment still comprises a means 24 for setting the stiffness of the two releasing springs 14 (FIG. 29).

The toepiece 10 according to the second embodiment comprises releasing elements of the same nature and having the same function as those described in relation to the first embodiment.

In FIG. 23, the fixed base 27 is absent in order to make it easier to understand mounting. The protrusion 21 that is integral with the fixed part 11 is in contact with the hollow 22 carried by the lever 16 belonging to the mobile part 12. The lever 16 is in the blocking position, the actuating element 17 being tilted upwards, and the blocking elements 25*d*, 25*g* are in abutment against the bearing surfaces 18*d*, 18*g* of the jaws in order to prevent any pivoting movement thereof with respect to the mobile base 26.

Finally, the invention relates to the gliding board as such, which comprises such a toepiece and/or such a binding device. Advantageously, the gliding board constitutes a touring ski.

The advantages of the solution described above are:

- the provision of a solution for securing a boot which is simple, fairly compact, economical and lightweight,
- the provision of a solution for securing a boot which ensures optimal safety for the skier in the event of a fall, respecting alpine standard ISO9462,
- the provision of a toepiece for releasing as a result of twisting, associated with a heel piece designed to release only in the event of a forward fall,
- also respecting touring standard ISO13992,
- use for touring, by virtue of a possibility of the boot pivoting upwards about the retaining elements 20*d*, 20*g* if the heel piece no longer retains the heel of the boot,
- the provision of a toepiece having a low fitting and removal force that is constant whatever the setting of the releasing force threshold selected by the skier.

An additional advantage is that the toepiece 10 described above gives the lever 16 two different functions:

- the fitting/removal function,
- an additional function of releasing as a result of twisting,
- a function of blocking the jaws that is active until releasing is necessary.

In summary, the principle is identical in the first and second embodiments and is as follows. The lever 16 is mounted so as to pivot, in particular on the mobile part 12, so as to change between:

- said blocking position, in which the blocking elements that are integral with the lever 16 take up a first position in which they block the jaws 13*d*, 13*g* in their closed positions and block the toepiece 10 in its closed configuration,
- said freeing position, in which the blocking elements that are integral with the lever 16 take up a second position different from the first position and in which they allow the jaws 13*d*, 13*g* to tilt.

The blocking elements pass from the first position to the second position and vice versa by way of the blocking elements moving by pivoting with respect to the mobile part 12 about an axis directed in the transverse direction: the blocking elements are mounted in an articulated manner, in particular a rotary manner about this axis, with respect to the mobile part 12.

In their first position, the blocking elements extend between the jaws 13*d*, 13*g* and bear against the bearing surfaces 18*d*, 18*g* of the jaws 13*d*, 13*g*. In particular in the second embodiment, the blocking elements 25*d*, 25*g* are kept in their first position as defined above by the action of the return spring 32.

The releasing elements 21, 22 cooperate with the blocking elements such that the execution of said movement of the mobile part 12 beyond the predetermined travel with respect to the fixed part 11 causes the blocking elements to pass automatically from their first position to their second position.

It is also apparent from all the above that the mobile part 12, in particular the mobile base 26, is acted upon by a first spring, formed by the transversely or longitudinally oriented releasing spring 14, while the blocking elements 25*d*, 25*g* are acted upon by a second return spring, which is independent of said first spring and urges the blocking elements 25*d*, 25*g* towards a position in which they prevent the jaws 13*d*, 13*g* from pivoting and block the toepiece 10 in its closed configuration. In the first embodiment, said second return spring is formed by the fitting/removal spring 23. In the second embodiment, said second return spring is formed by the return spring 32.

As indicated above, in each of the first and second embodiments, the first and second bearing surfaces 22, 21 are shaped such that their relative sliding causes the lever 16 to pass from its blocking position towards its freeing position, and concomitantly the blocking elements 25*d*, 25*g* to pass from their first position to their second position.

In each of the first and second embodiments, the toepiece 10 has:

jaws 13*d*, 13*g* that are able to rotate on a mobile base 26 of the mobile part 12, the transverse movement of which takes place counter to a force of a first return spring, in particular formed by the releasing spring 14 that returns the mobile part 12 towards a rest position, blocking elements 25*d*, 25*g* which take up a first position in which they block the pivoting of the jaws under the effect of a second return spring different from the first return spring, and releasing elements 21, 22 that cooperate with the blocking elements 25*d*, 25*g* such that the execution of said transverse movement beyond a predetermined travel causes the blocking elements to pass automatically, counter to the action of the second return spring, from the first position towards a second position in which the blocking elements 25*d*, 25*g* allow the jaws 13*d*, 13*g* to tilt so as to allow the jaws 13*d*, 13*g* to open and to free the boot.

Once again, in the first embodiment, said second return spring is formed by the fitting/removal spring 23, whereas in the second embodiment, said second return spring is formed by the return spring 32.

We claim:

1. A toepiece for a binding device for securing a boot to a gliding board, wherein the toepiece comprises:

a fixed part secured to the gliding board, a mobile part mounted by a mounting system on the fixed part adapted for relative movement with at least one transverse component and on which two jaws are mounted so as to pivot about a substantially longitudinal axis, a lever that is actuable from the outside of the toepiece and varies between a blocking position in which blocking elements that are integral with the lever prevent the jaws from tilting so as to keep the toepiece in a closed configuration in which the jaws are in closed position and a freeing position which is different from the blocking position and in which the blocking elements allow the jaws to tilt, and releasing elements that cooperate with the blocking elements such that:

a) within a predetermined travel of the mobile part with respect to the fixed part, the blocking elements are blocking the jaws in their closed position and the lever remains in the blocking position, and b) beyond the predetermined travel of the mobile part with respect to the fixed part, the releasing elements cause the lever to pass automatically from the blocking position towards the freeing position, the toepiece passing into its configuration for releasing as a result of twisting and the boot becoming freed from the jaws as a result of the tilting of at least one of the jaws from its closed position.

2. The toepiece according to claim 1, wherein the mounting system for mounting the mobile part on the fixed part is such that a sliding movement of the mobile part with respect to the fixed part takes place along a rectilinear path oriented substantially in the transverse direction, or along a curvilinear path with at least one component of the movement mainly in the transverse direction, said curvilinear path being approximately or exactly circular, delimiting a portion of a circle, the center of which is located toward the heel of the boot.

3. The toepiece according to claim 2, wherein the mounting system for mounting the mobile part on the fixed part comprises guiding elements that ensure that a mobile base of the mobile part is mounted on a fixed base of the fixed part so as to slide by translation.

4. The toepiece according to claim 2, wherein the mounting system for mounting the mobile part on the fixed part comprises two mutually parallel links that are arranged in the manner of a deformable parallelogram to ensure that a mobile base of the mobile part is mounted on a fixed base of the fixed part so as to move in circular translation.

5. The toepiece according to claim 1, wherein the blocking elements are mounted in a rotary manner, with respect to the mobile part in order to change between a first position, which is taken up in the blocking position of the lever and in which the blocking elements block the jaws and the toepiece in the closed configuration, and a second position, different from the first position, which is taken up in the freeing position of the lever and in which the blocking elements allow the jaws to tilt, and the releasing elements cooperate with the blocking elements such that the execution of said movement of the mobile part beyond the predetermined travel with respect to the fixed part causes the blocking elements to pass automatically from the first position to the second position.

6. The toepiece according to claim 1, wherein the lever is articulated on the mobile part.

7. The toepiece according to claim 1, wherein the toepiece comprises a knuckle joint mechanism provided with a fitting/removal spring that acts on the lever and is configured such that the blocking position and the freeing position are stable positions at the ends of an overall tilting travel of the lever, said travel including an unstable intermediate position of the lever corresponding to a hard point of inflection of the knuckle joint.

8. The toepiece according to claim 1, wherein the releasing elements comprise first and second bearing surfaces, which are respectively integral with the mobile and fixed parts, one in contact with the other, sliding one on the other during the execution of said movement of the mobile part, the first and second bearing surfaces being shaped such that this sliding causes the lever to pass from its blocking position towards the freeing position.

9. The toepiece according to claim 8, wherein the first bearing surface is carried by the blocking elements that are integral with the lever.

10. The toepiece according to claim 8, wherein one of the first and second bearing surfaces is formed by a protrusion and the other of the first and second bearing surfaces is formed by a hollow into which the protrusion penetrates prior to said movement of the mobile part and which is shaped such that the protrusion moves progressively out of the hollow during the sliding of the first and second bearing surfaces, such that the lever passes from the blocking position towards the freeing position.

11. The toepiece according to claim 10, wherein the hollow is integral with the lever and the protrusion is integral with the fixed part.

12. The toepiece according to claim 1, wherein the toepiece comprises at least one releasing spring which is interposed between the fixed and mobile parts and urges the mobile part into a rest position with respect to the fixed part.

13. The toepiece according to claim 12, comprising a means for setting the stiffness of the releasing spring.

14. The toepiece according to claim 12, wherein the blocking elements are acted upon by a return spring which is independent of the releasing spring and urges the blocking elements towards said first position, in which the blocking elements prevent the jaws from pivoting and block the toepiece in the closed configuration.

15. The toepiece according to claim 1, wherein the blocking elements are formed by lateral flanks of the lever which, in the blocking position of the lever, bear against bearing surfaces on an inner face of the jaws.

16. A binding device for securing a boot to a gliding board, comprising a toepiece according to claim 1, to secure a front part of the boot, and a heel piece to secure a rear part of the boot to the gliding board, the heel piece being designed to release the boot only in the case of a forward fall of a user, the boot being released from the binding device in the case of a fall with a twisting movement of the boot only by way of the toepiece.

17. A gliding board comprising:

a board; and a toepiece according to claim 1 and/or a binding device according to claim 16.

18. A toepiece for a binding device for securing a boot to a gliding board, wherein the toepiece comprises:

a fixed part secured to the gliding board, a mobile part mounted by a mounting system on the fixed part adapted for relative movement with at least one transverse movement component, jaws that are rotatable on a mobile base of the mobile part, the transverse movement component of which takes place counter to a force of a first return spring that urges the mobile part towards a rest position, blocking elements which take up a first position in which the blocking elements prevent the jaws from pivoting under the effect of a second return spring different from the first return spring, and releasing elements that cooperate with the blocking elements such that the execution of said transverse movement component beyond a predetermined travel causes the blocking elements to automatically pass, counter to the action of the second return spring, from the first position towards a second position in which the blocking elements allow the jaws to pivot so as to allow the jaws to open and to free the boot.

19. The toepiece according to claim 18, wherein the mounting system for mounting the mobile part on the fixed part is such that a sliding movement of the mobile part with respect to the fixed part takes place along a rectilinear path, which is oriented substantially in the transverse direction, or along a curvilinear path having at least one component mainly in the transverse direction, said curvilinear path being approximately or exactly circular, delimiting a portion of a circle, the center of which is located toward the heel of the boot.

20. The toepiece according to claim 18, wherein the blocking elements are mounted in a rotary manner, with respect to the mobile part such that the blocking elements pass from the first position to the second position and vice versa by the blocking elements pivoting with respect to the mobile part about an axis directed in the transverse direction.

21. The toepiece according to claim 18, wherein the releasing elements comprise first and second bearing surfaces, which are respectively integral with the mobile and fixed parts, one in contact with the other, undergoing relative sliding one on the other during the execution of said movement of the mobile part, the first and second bearing surfaces being shaped such that this relative sliding causes the blocking elements to pass from the first position towards the second position.

22. A binding device for securing a boot to a gliding board, comprising:

a toepiece according to claim 18 to secure a front part of the boot, and a heel piece to secure a rear part of the boot to the gliding board, the heel piece being designed to release the boot only in the case of a forward fall of a user, the boot being released from the binding device in the case of a fall with a twisting movement of the boot only by way of the toepiece.

23. A gliding board comprising a binding device for securing a boot to the gliding board, the gliding board comprising:

a toepiece according to claim 18 to secure a front part of the boot, and a heel piece to secure a rear part of the boot to the gliding board, the heel piece being designed to release the boot only in the case of a forward fall of a user, the boot being released from the binding device in the case of a fall with a twisting movement of the boot only by way of the toepiece.

* * * * *

UNITED STATES PATENT AND TRADEMARK OFFICE

CERTIFICATE OF CORRECTION

PATENT NO. : 9,155,956 B2
APPLICATION NO. : 14/186433
DATED : October 13, 2015
INVENTOR(S) : Pierre Rullier and Arnaud Moenne Loccoz It is certified that error appears in the above-identified patent and that said Letters Patent is hereby corrected as shown below:

On the title page item 73

The name of the Assignee:

should be changed from "Skis Rossignul" to --Skis Rossignol--.

Signed and Sealed this
Fifteenth Day of March, 2016

Michelle K. Lee

Michelle K. Lee
*Director of the United States Patent and Trademark Office*